US005573656A

United States Patent [19]

Santos

[11] Patent Number: 5,573,656

[45] **Date of Patent: *Nov. 12, 1996**

[54] PROCESS FOR CONVERTING ACID SLUDGE TO ASPHALT

[76] Inventor: Benjamin Santos, P.O. Box 1170, Manilla, Philippines

[ * ] Notice: The term of this patent shall not extend beyond the expiration date of Pat. No. 5,288,392.

[21] Appl. No.: 198,189

[22] Filed: Feb. 16, 1994

Related U.S. Application Data

[63] Continuation-in-part of Ser. No. 71,775, Jun. 4, 1993, Pat. No. 5,514,272, which is a continuation-in-part of Ser. No. 879,634, May 7, 1992, abandoned, and a continuation of Ser. No. 879,642, May 7, 1992, Pat. No. 5,288,392.

[51] Int. Cl.[6] ..... C10G 17/02

[52] U.S. Cl. ..... 208/13; 208/179; 208/181; 208/182; 208/183

[58] Field of Search ..... 208/13, 179, 181, 208/182, 183

[56] References Cited

U.S. PATENT DOCUMENTS

| | | | |
|---|---|---|---|
| 3,971,713 | 7/1976 | Ellender, Jr. | 208/226 |
| 4,029,569 | 6/1977 | Ivey, Jr. | 208/180 |
| 4,238,241 | 12/1980 | Schneider | 106/281 |
| 4,559,128 | 12/1985 | Goodrich | 208/22 |
| 5,049,256 | 9/1991 | Luce | 208/13 |
| 5,288,392 | 2/1994 | Santos | 208/13 |

OTHER PUBLICATIONS

Kirk–Othmer, "Asphalt" Encyclopedia of Chemical Technology, Third Edition, vol. 3, Antibiotics (Phenazines) to Bleaching Agents, pp. 299–302 (no date).

Interline Resources Corporation, "Interline Re–refining Process", Executive Summary, Oct. 1993.

M. L. Whisman, J. W. Goetzinger, and F. O. Cotton, "Petroleum Refinery Engineering", Report of Investigations 7884, Waste Lubricating Oil Research, pp. 228 (1974). (no month).

W. L. Nelson, "Chemical Treatments", Petroleum Refinery Engineering, Fourth Edition, pp. 261/292–297 (1958). (no month).

English Transaction of Patenschrift, DE 42 05 885 C1, for Bernard Meinken (Mar. 1993).

English Translation of Offenlegungsschrift, DE 42 05 884 A1, for Bernard Meinken (Sep. 1993).

N. J. Weinstein, "Disposal of Recovery Process Residues" Waste Oil Recycling and Disposal, Aug. 1974, p. 170.

"Waste Oil" Texy by Mueller Associates Inc. (1989) (no month).

*Primary Examiner*—Anthony McFarlane
*Assistant Examiner*—Walter D. Griffin
*Attorney, Agent, or Firm*—Ron Fish; Falk, Vestal & Fish

[57] ABSTRACT

A process for significantly decreasing the acid sludge settling time in waste oil recovery processes comprising the steps of heating used oil to a high temperature above 725 degrees Fahrenheit, cooling the heated oil, adding an oxidizing agent to the oil, allowing the acid sludge to settle within a period of approximately 24 to 72 hours, separating the acid-sludge-free oil from the acid sludge which settles out of solution as a result of addition of the oxidizing agent, and adding a polishing agent and separating the re-refined oil from the spent polishing agent. The spent polishing agent is recycled, and the acid sludge which settles out after oxidation is converted to either hard, oxidized asphalt or soft asphalt or asphalt products such as emulsions etc. The process produces a high quality re-refined oil rapidly and economically with no acid sludge disposal problem.

39 Claims, 8 Drawing Sheets

RE-REFINED LUBE STOCK/ASPHALT BATCHWISE RE-REFINING PROCESS

PROCESS FOR CONVERTING ACID SLUDGE TO ASPHALT

BACKGROUND OF THE INVENTION

1. Field of the Invention

This is a continuation-in-part of a U.S. patent application, Ser. No. 08/071,775, filed Jun. 4, 1993 (APO-001.1P) entitled "AN IMPROVED PROCESS FOR RE-REFINING USED OIL" (now U.S. Pat. No. 5,514,272 , which was a continuation-in-part of a U.S. patent application entitled "AN IMPROVED PROCESS FOR RE-REFINING USED OIL", Ser. No. 07/879,634, filed May 7, 1992 (now abandoned), and is also a continuation of a U.S. patent application, Ser. No. 07/879,642, filed May 7,1992 entitled "A PROCESS FOR CONVERTING ACID SLUDGE INTO INTERMEDIATE SLUDGE" (which issued as U.S. Pat. No. 5,288,392 on Feb. 22, 1994).

The present invention pertains to re-refining used oil and in particular, to a process for significantly decreasing acid sludge settling times in used oil refining processes.

2. Description of the Prior Art

Because of the huge volume of used oil from vehicle engines and the oil shortage, an oil recycling industry has grown up. Prior art processes for re-refining used mineral lubricating oil include the acid-clay method, extraction acid-clay method, distillation clay method, distillation-hydrotreating method, and the distillation method. The acid-clay method is the most widely used method.

The older acid-clay re-refining processes used to recover used oil involve heating the used oil to a temperature in the range of 212°–550° F., cooling the heated oil, adding acid to oxidize and remove the carbonaceous impurities, metal components and other oxidized materials, and then waiting weeks or months for the acid sludge to settle.

During the lengthy interval in which the acid sludge settles, the acid, which had been added to the oil during the cooling step, is still present and in contact with the oil. Typically the acid is sulfuric acid. The lengthy contact with the sulfuric acid causes the oil to become dark brown and "burnt" or "charred" in color. The longer the oil is in contact with the acid, the darker the oil becomes. In addition, prolonged contact of the acid with the oil causes the resulting re-refined oil to be very acidic. An acidic oil is corrosive and cannot be used.

These prior art oil re-refining processes are very time consuming because of the extensive amount of time required to achieve complete settling of the acid sludge. As a result, oil recovery using these processes is not economical. In addition, these processes have had very limited success in producing quality lubricating oil. To achieve a high quality re-refined lubricating oil, all acid sludge must be removed from the oil and the color must be lightened for most consumers of such oil. However, high quality lubricating oils are difficult to produce through re-refining processes, because even after weeks or months have elapsed, the acid sludge does not settle, or has incompletely settled. Consequently, impurities remain suspended in the oil and the resulting oil is of low quality. Therefore, complete and rapid settling of the acid sludge is essential to achieving high quality, low cost, re-refined lubricating oil.

Failure of the prior art to develop a used oil re-refining process in which the acid sludge settles rapidly and which eliminates the acid sludge disposal problem led to the abandonment of the acid-clay re-refining process in the U.S.

over the last 10 years or so. The slow settling of the acid sludge which made the prior art acid clay re-refining process commercially unattractive has been aggravated by the cars which are currently being manufactured. The cars of today have smaller and more lightweight engines. These smaller engines get hotter than the larger engines of the past. This additional heat causes the oil to break down faster thereby producing carbon and carbonaceous impurities to build-up in the oil. Therefore oil companies are increasingly placing more additives, such as dispersant, detergent, viscosity improving compounds, or antisludge compounds, etc. into the oil. Over the years it has been shown that these additives have caused a gradual increase in the acid sludge settling time. Therefore, the problem of long settling times in prior art re-refining processes has grown even greater.

One improvement over the prior art acid clay re-refining process is represented by U.S. Pat. No. 4,029,569 to Ivey, filed Sep. 16, 1995. In this patent, Ivey teaches an acid clay re-refining process wherein the feed stock used oil is heated to a temperature in the range from 700° F. to 720° F., preferably 710° F. for about 30 minutes to cause precipitation of a substantial portion of the suspended solids. Ivey teaches that temperatures above 725° F. should not be used because such temperatures create too many oxygenated products in the used oil. Ivey then filters out the oil from the precipitated solids and contacts the filtered oil with sulfuric acid, preferably 3–6%, preferably 4% by volume which he teaches as destroying the dispersant properties of the detergent additives and substantially completes the precipitation of suspended solids. Another step is then performed such as filtration to separate the oil from the precipitated solids, and the filtered oil is pH altered by contacting it with a sufficient amount of an organic amine to raise the pH to about 8. Filterling through a polish filter is then performed to generate a finished oil. No yield figures are given nor are any figures of merit for color, or odor of the finished oil. Further, Ivey teaches that approximately 50% of the feed stock is lost to acid sludge in the prior art process upon which he improved but does not state what percentage of his feed stock is lost to acid sludge. Ivey teaches no method for disposing of the acid sludge or converting it to a useful product.

Thus, there has arisen a more urgent need to develop a process for recovering waste oil rapidly and economically by decreasing the acid sludge settling time, and, most importantly, eliminating the acid sludge disposal problem.

SUMMARY

The present invention is a process for decreasing the acid sludge settling time in waste oil recovery processes to re-refine lube stocks or fuel oils using the acid-clay method and for converting the acid sludge into saleable asphalt products. Common to the processes of making either lube stock or fuel oils are the steps of heating the feed stock used oil to a temperature above 725 degrees Fahrenheit to dissociate the additives, cooling the heated oil, adding sulfuric acid to the oil to oxidize the oxidizable components in the oil, allowing the acid sludge resulting from the addition of the sulfuric acid to settle, over an interval of from one to three days (usually less than one day), and then separating the acid-sludge-free oil from the acid sludge. In processes to make lube stock, the process is finished by adding approximately 10% by volume activated clay to the acid- sludge-free oil as a polishing agent to improve its color and alter its pH to a neutral value, around 7 and steam sparging to deodorize the resulting oil. Finally, the resulting colorlightened, re-refined oil is separated from the spent polishing agent by a diatomaceous filter, and the clay cake is reactivated by baking it in a kiln so that it can be recycled thereby eliminating the problem of disposing of the spent clay.

Steam sparging, i.e., bubbling of steam through the oil while it is being heated, is preferred to eliminate odor from the finished product, but is not necessary in embodiments where odor is not a criteria for the output product. Steam sparging may be performed with the oil either at atmospheric pressure or with vacuum applied thereto to prevent any odorous gases from escaping into the surrounding neighborhood. Steam sparging may also be done at a later stage such as during the polishing step where activated clay is added to improve the color of the finished product.

In some alternative embodiments of the lube stock re-refining process, inert gas is pumped into the vessel containing the oil for the initial heating step so as to fill the space above the oil. This minimizes the possibility of explosion of any light ends which have out gassed from the heated oil. However, the preferred method is to draw the light ends off by vacuum and condense them in a heat exchanger so that they may be recycled as fuel for the burner which heats the feed stock or used to generate low viscosity fuel oils. In most embodiments of the lube stock re-refining process, agitation is performed after the oxidizing agent has been added to insure thorough mixing of the oxidizing agent.

In particular, the high temperatures used in the process of the present invention in conjunction with the other steps of the process both decreases the settling time for the acid sludge to settle thereby reducing the exposure of the oil to the oxidizing agent, as well as increases the efficiency of the acid sludge settling. This increases the yield over prior art acid-clay re-refining processes from about 50% up to about 75%. The high temperature step also reduces the amount of acid used as compared to the prior art acid clay process. Further, the lube stock re-refining process according to the teachings of the invention enjoys increased quality of the recovered oil by lightening its color to about 2.5 on the ASTM scale and completely eliminating any odor. The lube stock re-refining process according to the teachings of the invention has a substantially reduced manufacturing cost. This results from the decrease in settling time to remove the acid sludge and from the reduced need for acid. Further, the capital cost to build a re-refining plant according to the teachings of the invention to generate lube stocks is substantially less than the cost to build a lube stock re-refining such as in common use today at re-refers such as Evergreen and Safe-T-Kleen because of the complete elimination of the need for hydrogenation equipment which is very expensive. Hydrogenation is carried out at very high temperature and pressure and, as a result, requires very thick and strong metals in all associated containment structures. In addition, hydrogen itself is expensive, explosive and difficult to contain without leaks. Hydrogenation is necessary in the re-refining plants using a vacuum distillation separation process to remove the impurities so as to eliminate the odor of the re-refined oil. If hydrogenation is not done in any process using either vacuum distillation or propane extraction to separate the lube stocks from the impurities in the used oil, the output re-refined oil will have an odor problem and will not sell well or at all.

DETAILED DESCRIPTION

Figure 1:
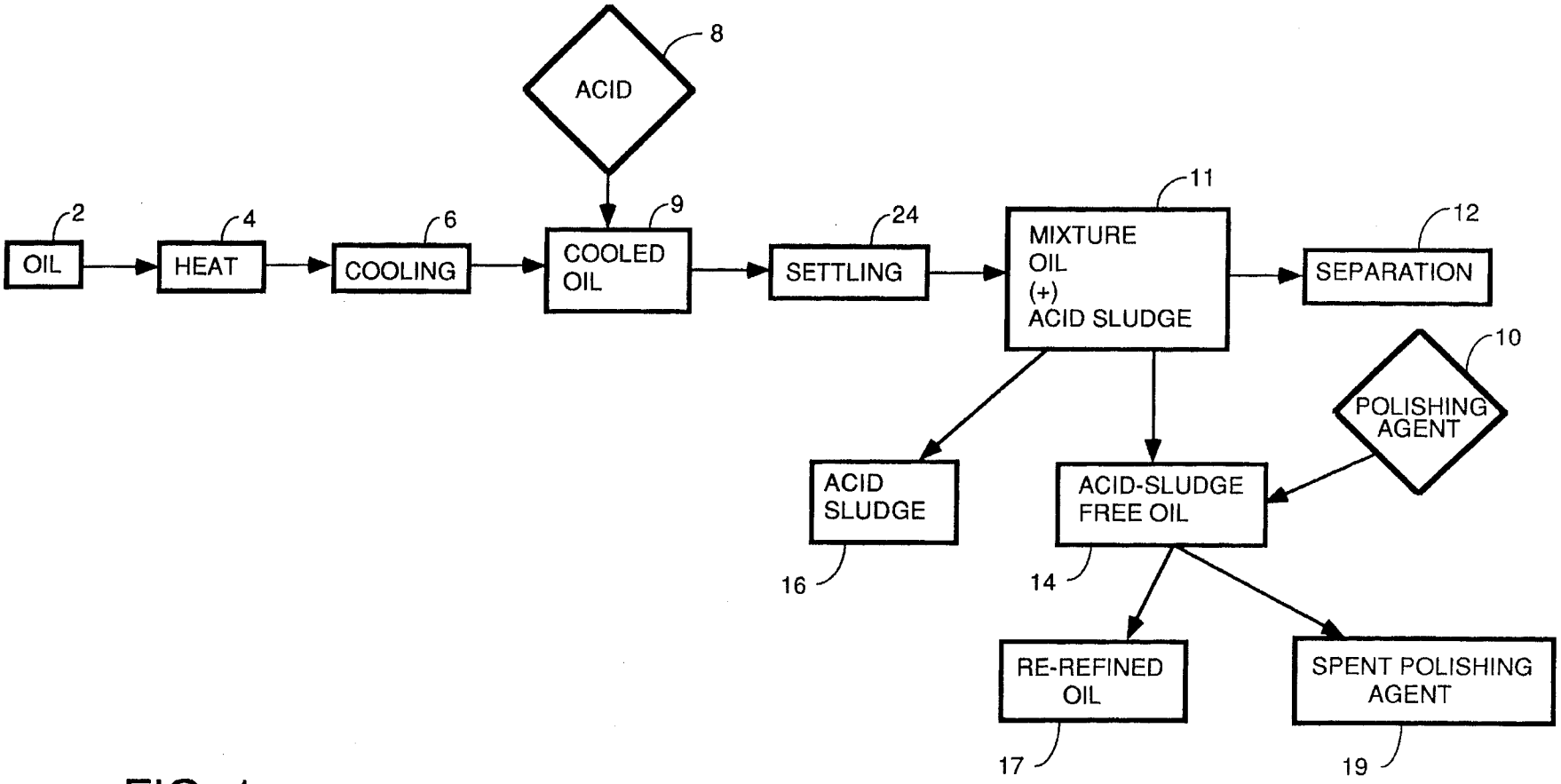
FIG. 1, is a schematic diagram of the re-refining process of the present invention.

Referring to FIG. 1, the present invention is a process for re-refining used oil. The process will decrease the acid sludge settling time which will enable the rapid and economical refining of used oil into a very high quality re-refined oil.

The process of the present invention comprises the steps of:

a) providing used oil (step 2);

b) heating the oil (step 4);

c) cooling the oil (step 6);

d) treating the cooled oil (block 9) with $H_2SO_4$ (step 8) and, optionally, agitating;

e) allowing the resulting acid sludge to settle (step 24) over the space of from one to three days to generate a mixture of relatively pure, acid-sludge free oil and acid sludge (block 11);

f ) separating (step 12) the acid-sludge-free oil (block 14) from the acid sludge (block16); and g ) adding polishing agent (step 10) to the acid-sludge-free oil and separating the re-refined oil from the spent polishing agent resulting in a rapidly-produced, high-quality re-refined oil (block 17) and spent polishing agent (block 19).

The process according to the teachings of the invention drastically decreases the acid sludge settling time, increases total yield from typical yields of around 50% in the prior art to approximately 75% in the process according to the teachings of the invention,, and increases the quality of the recovered oil by lightening its color.

The process in more detail is as follows. The starting material is used lubricating oil (step 2). Generally, this used oil is gathered from any used oil source such as auto repair shops, industrial plants, etc. Typically, the used oil is used mineral lubricating oil of automotive or industrial grade and the like. These used mineral lubricating oils contain a variety of components including carbonaceous impurities, metal components, other oxidizable materials, water, additives and alcohols.

Heat (step 4), is applied to the oil to drive off water, break down additives and vaporize volatile components such as light ends, chlorinated compounds etc. and to enable rapid acid sludge settling. It is believed that the high temperatures of the process according to the teachings of the invention dissociate or evaporate the additives, especially the dispersant or detergent additives, which slow down or prevent settling of acid sludge in prior art acid clay re-refining processes. Heat can be applied to the oil according to a variety of different processes. Some of these processes include, dehydration, fractionation, distillation and extraction. These processes are well known in the art.

In general, the oil is heated to temperatures in the range of from greater than 725° F. to 1000° F., preferably 726° F. to 850° F. although the range from greater than 726° F. to 750° F. is also used. Typically, oil re-refining processes of the prior art heat oil to temperatures in the range of from 212–550° F. and teach avoidance of temperatures above the cracking temperature at around 680° F. to avoid thermal breakdown of the long hydrocarbon chain molecules essential to good lubricating qualities. That is, prior art processes rarely require temperatures above 550° F. because of the adverse effects such temperatures have on the yield and the equipment used. Because of the nature of the oil molecules, high temperatures will cause degradation of the oil by cracking. Cracking is defined as larger hydrocarbon chains breaking down into smaller chained compounds. In other words, a long chain hydrocarbon, i.e., a hydrocarbon having a number of carbon atoms, will break up into smaller chain hydrocarbons. Another term for these small chain hydrocarbons is "light ends". Thus, the cracking process which occurs at high temperatures causes light ends to form. These light ends are more volatile than the original oil and can lead to explosions or fires and personal injury or damage to the re-refining equipment.

Although cracking occurs to some extent at the prior art temperatures of 212–550° F., the extent of cracking is generally expected to increase significantly as the temperature of the oil is increased. For example, at temperatures above 550° F., the extent of cracking was expected by prior art workers to be so great as to make the process undesirable, both economically and in terms of the end product.

Another reason prior art processes do not require temperatures above 550° F. pertains to the equipment used in oil re-refining processes. The equipment used in prior art re-refining processes is not designed to function continuously at temperatures above 600° F. If such equipment is exposed to such high temperatures for long periods of time, it will break down. Since the equipment is very costly to replace, there is little motivation to intentionally operate at such extreme temperatures. Therefore, there was perceived in the prior art little or no advantage in raising temperatures above 600° F. and, in fact, workers in the art were advised not to exceed the cracking temperature because of these adverse effects.

In contrast to the prior art, one of the unexpected results of the present process is the lack of a significant decrease in yield when the oil is heated to temperatures above 725° F. In fact, although temperatures well above the traditional cracking temperatures are used, a significant increase in yield has been experienced. The applicant has discovered that, although there is some cracking when the oil is heated to temperatures above 725° F., the extent of cracking is not appreciably greater than that which occurs at 212–550° F. (the process temperatures of the prior art) for reasons which are not completely understood.

Another advantage to heating the oil to temperatures in excess of 725° F., is a significant decrease in acid sludge settling time. The phrase "settling time" refers to the time it takes to achieve complete settling of the acid sludge in the recovery vessel. The degree of settling determines the quality of the oil. For example, the more complete the settling, the higher the quality of the oil. When complete settling is achieved, the purified oil can be removed and processed further to an oil of near virgin quality.

In the process according to the teachings of the invention, the time for complete settling is in the range of from one to three days. Therefore, the entire recovery process of the present invention is completed within a very short period of from one to three days which is substantially shorter than the typical prior art settling time of two or more weeks, usually about one month. Further, in the prior art processes even though settling times of weeks were experienced, complete settling never actually occurred which led prior art workers to add more and more acid in an attempt to accelerate the process.

In the process according to the teachings of the invention, the oil is heated to a temperature above 725° F. which is sufficient to achieve complete acid sludge settling within 72 hours and usually within 12–24 hours when the cooled oil is mixed with an oxidizing agent such as sulfuric acid.

To heat 1000 gallons of used lubricating oil to a temperature in the range of from 726°–750° F. takes somewhere between a fraction of an hour to several hours. The amount of heating time can be decreased in a number of ways, for example, by increasing the heating surface area of heating coils immersed in the used oil, by increasing the BTU heating capacity of the heater, or by decreasing the volume of used lubricating oil to be heated or any combination of these techniques.

In addition, the quality of the used oil will affect the heating time. For example, if the oil contains water or is very viscous, the heating time will be longer. However, the interval during which heat is applied is not critical. Generally the heating interval is dependent upon the flash point of the waste oil being refined. An oil having a high flash point will require a longer heating interval than an oil having a low flash point. However, once the temperature of 726°–850° F. has been reached, there is no need to apply further heat.

The oil is then removed from the heat and allowed to cool (step 6) to approximately room temperature, i.e., from 70° F.–120° F. There are a variety of methods by which the oil is cooled. Heat transfer is one method. During heat transfer, the, oil cools by virtue of the heat from the oil transferring to the ambient in which the oil recovery vessel is located through the vessel walls and the surface of the oil. Alternatively, the vessel containing the heated oil is cooled by an active cooling source. For example, the vessel containing the heated oil cools by exposing the vessel to cold water, cold air, or a low boiling point chemical which may be circulated through cooling coils immersed in the oil. It is preferred to use a shell and tube heat exchanger through which water flows to cool the heated oil.

When the oil has cooled, sulfuric acid (step 8) is added to the oil. The concentration of the sulfuric acid in the acid stream on line 75 is in the range of from 80–98 wt %. The volume of sulfuric acid added to the cooled oil (step 9) is that volume which is sufficient to generate complete sedimentation of the acid sludge within 72 hours but preferably within 12–24 hours. The quantity of acid utilized in the present process is generally in the range of from 3 to 15% $H_2SO_4$ by volume, and, preferably, between 5–10% $H_2SO_4$ by volume. Excess acid will be wasted and therefore is unnecessary. In addition, excess acid could result in a poor quality refined oil. The sulfuric acid oxidizes carbonaceous materials, metals, and all oxidizable components in the waste oil to create acid sludge. Oxidation of the various impurities facilitates the removal of those impurities in the acid sludge to leave a quantity of acid-sludge-free oil (block 14) and increases the eventual quality of the re-refined oil (step 17).

The concentration of the sulfuric acid affects the color of the resulting re-refined oil produced in the present process. As the concentration of the sulfuric acid increases, the color of the lubricating oil becomes whiter thereby increasing the quality of the lubricating oil. However, if the acid is allowed to remain in contact with the oil for a lengthy period, the oil will become charred and unusable. Therefore, it is desirable to minimize the acid-oil contact interval in order to obtain a re-refined oil that is as white as possible. Generally, the color of the re-refined oil generated in the present process is in the range of from 2.0–5.0 and preferably 2.0–3.0 according to the color scale of ASTM (American Society for Testing and Materials) Method D1500. This method is well-know by those skilled in the art.

This mixture of acid and impurities is termed "acid sludge." Thus, what had been only oil is now a mixture of oil and acid sludge symbolized by block 11 in FIG. 1. Complete settling is achieved when the acid sludge is approximately 20–30 volume percent of the oil leaving approximately 70–80% of the volume of used oil remaining after heating as acid-sludge-free oil (block 14). After the acid sludge has settled out, the oil and acid sludge are separated as symbolized by step 12 into acid sludge (block16) and acid-sludge-free oil (block 14). Separation can be achieved using a number of different processes, for example, decanting, suctioning, gravity, centrifuge, etc.

A polishing agent (10) is added to the oil to facilitate removal of particles which color the oil. In addition, the polishing agent deodorizes, decolorizes and deacidifies the oil. The polishing agent should have large pores and large surface area per particle to absorb oxidized particles and those particles which color the oil. The polishing agent can be clay, bleaching earth, activated carbon, bauxite or the like but clay and bleaching earth are preferred. After the polishing agent is spent (block 19), it is separated from the rerefined oil.

The resulting re-refined oil (step 17) is a high quality oil having ASTM color scale in the range of from 2.0–5.0 preferably 2.0–3.0 and has a viscosity in the range of from 5–20 centistokes when measured at 100° C.

Figure 2:
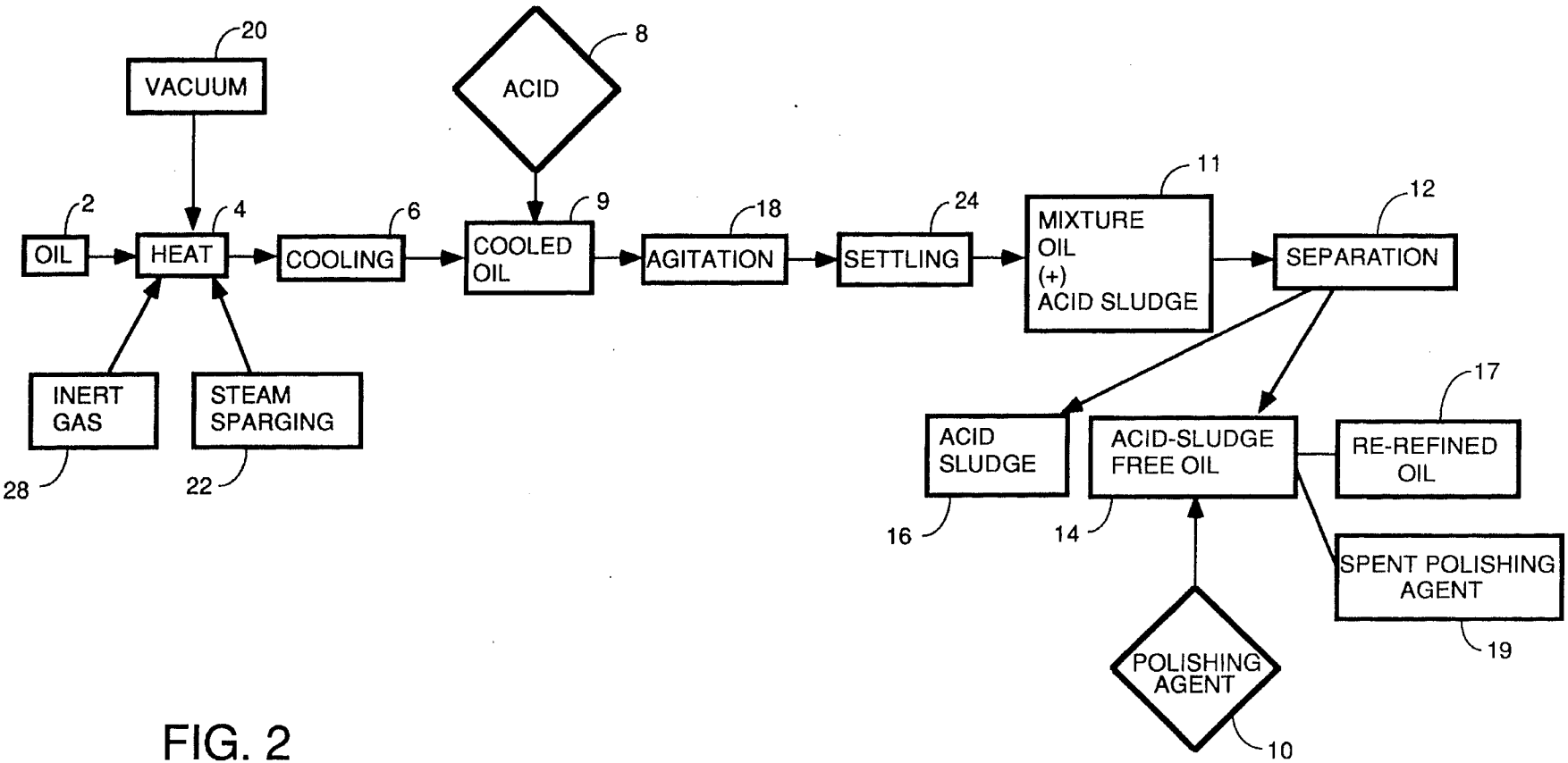
FIG. 2, is a schematic diagram of the re-refining process of the present invention in which vacuum, steam sparging and inert gas are applied, separately or in combination, during the heating step.

FIG. 2 is a process flow diagram showing an alternate embodiment of the present process for re-refining used oil. The process comprises the steps of: heating the oil (step 4); applying vacuum (step 20), sparging with steam (step 22) or inert gas (step 28) or a combination thereof, while heating the oil; cooling the oil (step 6); adding acid to the cooled oil (step 8); agitating the mixture (step 18) and allowing the acid sludge to settle (step 24) to create a mixture of oil and acid sludge (block 11); separating the oil from the acid sludge (step 12) to get acid-sludge-free oil (block 14) and acid sludge (block 16); adding polishing agent (step 10), and separating the spent polishing agent (block 19) from the re-resulting re-refined oil (block 17).

In this preferred embodiment, the cooled oil is agitated (step 18) during or after the acid oxidizing agent is added. Agitation enables a more complete and rapid oxidation of the various oxidizable compounds in the oil. After the oxidizing agent is added and the agitation is complete, the acid sludge is allowed to settle (step 24).

In addition, in this embodiment, vacuum is applied during heating to help remove volatile components. The level of pressure applied to the used oil during the heating process can range from full vacuum to a pressure above atmospheric pressure. The preferred pressure is a vacuum measuring 10–30 inches Hg on a vacuum gauge. The vacuum application (step 20) is applied by using a closed container to hold the used oil with the space in the container above the used oil coupled to a source of vacuum. Application of vacuum (step 20) facilitates removal of the light ends by outgassing. Application of vacuum also functions as a safety mechanism to remove vaporized additives and light ends. When the light ends outgas, they are in the form of an explosive gas. Therefore, removing the light ends through a vacuum source prevents the accumulation of a gaseous ignitable mixture of various light ends in an area where agitation motors, which generate sparks, and heaters, which may use open flames, are operating. The vacuum (step 20) therefore eliminates a potentially explosive situation. These light end byproducts have market value in that they are a potential source of energy. For example, these light ends can be used as fuel for producing power or in heating the next batch of oil to be refined. Alternatively, the light ends may be used to power all or some energy consuming steps of the refining process according to the teachings of the invention.

Steam sparging (step 22) also facilitates the removal of light ends. The phrase "steam sparging" means bubbling steam through the solution. In the present process, steam is bubbled through the oil to increase the rate at which the light ends outgas from the oil. Typically in steam sparging, saturated or super-heated steam is used. The steam also functions to dilute the concentration of light ends as they are expelled. Thus, the gaseous mixture of light ends is leaner and less likely to ignite. Applying a combination of steam sparging (step 22) and vacuum (step 20) increases the rate of removal of light ends.

Alternatively, according to the teachings of the present invention, inert gas (step 28) may be pumped into the closed chamber holding the oil during heating (step 4). The function of the inert gas is similar to that of steam. When inert gas is injected into the hot oil, it forces out the air which is present above the oil surface. Because light ends such as gasoline, gas oil, naphtha, etc. are continuously generated from the hot oil during heating, the use of inert gas greatly reduces the possibility of explosion. Any inert gas may be used. Typically nitrogen and helium work well. However, helium is rather expensive in comparison to nitrogen.

This invention is further illustrated by the following specific but non-limiting examples. Examples which have been reduced to practice are stated in the past tense, and examples which are constructively reduced to practice herein are presented in the present tense. Temperatures are given in degrees Fahrenheit unless otherwise specified.

Figure 3:
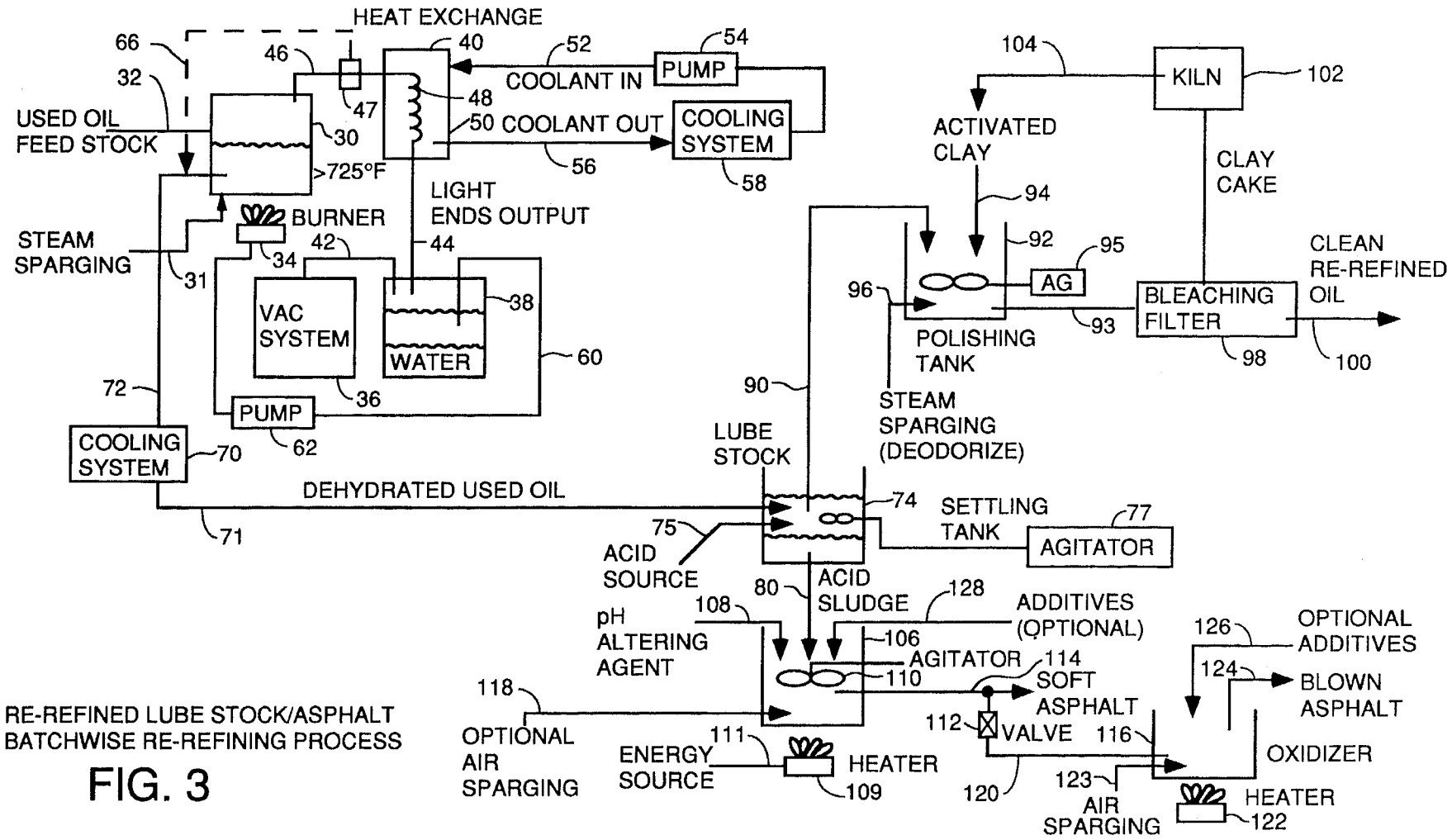
FIG. 3 is a process flow diagram of a batchwise plant for refining clean re-refined oil from used oil having chlorine content below EPA 1000 PPM upper limit and low sulfur Content including a process to convert any acid sludge created to soft and/or oxidized asphalt.

Referring to FIG. 3 there is shown is a process flow diagram of a batchwise plant for refining clean re-refined oil from used oil having chlorine content below EPA 1000 PPM upper limit and low sulfur content including a process to convert any acid sludge created to soft and/or oxidized asphalt. The re-refining process described generally in FIGS. 1 and 2 can be performed in a number of different ways depending upon the desired volume and upon the characteristics of the used oil feed stock in terms of its sulfur and chlorinated compounds content. FIGS. 3–8 represents process flow diagrams of plants which can re-refine either lube stocks or heavy and light fuel oils from used oil with sulfur and chlorine compounds either above or below EPA threshold limits, all of which have the capability of removing lead, other heavy metals and additives from the feed stock to generate a clean, odorless, high quality output lube stock or fuel oil. The basic technology used in all these plants is a significant improvement in the prior art acid-clay re-refining process which speeds up the process by a factor of 30 or more for used oils with additives including dispersants as are commonly found in used oils taken from the crankcases of U.S. transport vehicles. The process also uses less than about ⅓ or less of the acid needed in prior art acid-clay processes applied to used oils with present day heavy additive content. Finally, and of significant importance, all the plants shown in FIGS. 3–8 have the capability of completely eliminating the environmental disposal problems of acid sludge which plagued prior art acid-clay re-refining facilities and caused substantially all such plants in the U.S. to shut down.

A key factor in the improved acid-clay re-refining process shown in FIGS. 3–8 is the first heating step in tank 30. In this step, the used oil feed stock entering on line 32 enters enclosed tank 30. This used oil should be tested for its chlorinated compounds and sulfur content before it is put in tank 30, because the level of these compounds in the used oil dictates whether certain process steps to be described below are or are not necessary. The process of FIG. 3 assumes that the sulfur content and chlorinated compounds contents are below the EPA threshold levels such that the light ends that boil off in the first heating step can be directly recycled to the burner 34 for the first heating step so that the plants major energy consuming step can be essentially self-powered. Burning high sulfur content light ends is undesirable because of the odor caused. If the sulfur and/or chlorinated compound content is above EPA threshold levels, then the process steps in FIGS. 6–8 can be performed to eliminate these compounds. Also, in some embodiments and depending upon market conditions, it may be more desirable to refine the light ends into clean, light fuels and sell these fuels rather than recycle the light ends to the burner 34.

The first heating step in tank 30 is important to the process because it is this step where the advantage of vastly speeded up settling time and substantially less acid consumption is enabled. The used oil is heated in tank 30 to a temperature above 725° F., or at least above the dissociation temperature of the dispersant additive(s). It is known from experimental results that the fastest settling times are achieved when the used oil is heated above the virgin oil cracking temperature of 675°–680° F. to 726° F. or above, preferably 726°–750° F. The applicant believes that the dissociation temperatures of the dispersant additive(s), and probably the other performance enhancement additives, is somewhere between 726°–750° F. In any event, whatever the dissociation temperature of the dispersant additive is, best results are achieved if the used oil in tank 30 is heated to a temperatures above the dissociation temperature of the dispersants and above 725° F. and preferably 750° F.

Steam sparging, i.e., bubbling steam through the oil, in tank 30 is also performed while the used oil in tank 30 is being heated, as symbolized by line 31. This steam sparging step, in addition to speeding the process of removing the light ends, also renders the process safer. There is a certain minimum or lean mixture of air/oxygen and fuel vapors which are explosive, and there is also a certain maximum or rich mixture of air and fuel which represents the maximum ratio of fuel to air which will explode. Any mixture more lean than the lean limit or more rich than the rich limit will not explode. The steam sparging makes the mixture more lean than the lean limit by displacing some of: the air or some of the fuel. This eliminates the possibility of explosion. This step is optional however because tank 30 is preferably enclosed and subjected to vacuum during the heating via vacuum line 46. This structure contains the explosive vapors and draws them off through the condenser 40. A combination of vacuum and steam sparging speeds the process of removal of light ends even more and is preferred.

Because used oil is a conglomeration of many compounds having different boiling points, some lighter molecular weight compounds will vaporize during the process of heating the used oil to 726°–750° F. In addition, water and chlorinated compounds, which have boiling points down around 140° F. to 350° F., will also vaporize during this first heating step. Because these compounds are volatile and potentially explosive or hazardous to worker health, tank 30 is enclosed and a vacuum of about 10–25 inches of mercury below atmospheric pressure (preferably 20–25 inches Hg) is drawn thereon. This subatmospheric pressure is applied by vacuum system 36 through collection tank 38 and heat exchanger/condenser 40. The vacuum system 36 can be a vacuum pump, venturi system, steam jet ejector, etc. The subatmospheric pressure is applied via line 42 to tank 38. This vacuum is coupled via the tank 38 to the output end 44 of the heat exchanger/condenser 40 and from there to the tank 30 via the condenser input line 46. This vacuum draws the volatile light ends, chlorinated compounds, and water vapor out of tank 30, through condenser/heat exchanger 40 where the vapors are converted back into liquid form and flow through line 44 into collection tank 38.

The condenser 40 is comprised of any suitable heat exchanger, preferably a shell and tube type. In FIG. 3, the light ends and other volatile vapors are led through tube while coolant such as water at ambient temperature is circulated through the internal space within shell 50 via a closed loop cooling system comprised of coolant input line 52, pump 54, coolant output line 56, and cooling system 58. The cooling system 58 can be a cooling tower, refrigeration unit etc. The condensed light end compounds and water are collected (no chlorinated compounds are assumed to be in the feed stock) in tank 38. The water settles to the bottom, and the light end fuels are pumped via line 60 and pump 62 to burner 34. Some external energy supply (not shown) must be used to get the process started. The water can be deodorized using air sparging, and given to farmers as dust pallative, irrigation water or dumped (no chlorinated compounds are assumed to be present in the input feed stock).

The heating step in tank 30 is only symbolic as this heating may be accomplished in many different ways. For example, a furnace may be used in which the used oil is pumped through tubes inside the furnace fires. Also, the used oil may be collected in a tank with flue tubes running therethrough to exchange heat with the used oil. The flue tubes have burners at the mouths thereof, and hot flue gases are blown through the flue tubes to heat the oil. The best way of heating the used oil depends upon whether a continuous or batch process is desired. For high volume, continuous processes, the furnace method is preferred. The flue tube process is preferred for batch processes where output volume is lower. The heating process symbolized by tank 30 should be carried out for a time sufficient to vaporize all volatile compounds, but in either case of batchwise or continuous processes, the used oil must be heated above 725° F°. Typically, the heating time in a batch process is 1–2 hours. The time for a continuous process must be experimentally determined, but, in general, it is only a few minutes at most or a sufficient amount of time to cause the used oil to reach at least 726° F.

In the continuous furnace process, the output stream on line 46 is a two-phase stream comprised of vapors and a liquid component. Separation of the liquid phase from the vapor phase is accomplished by a separator 47 which takes advantage of the fact that the vapor phase has a high pressure. Separator 47 allows the vapor phase to flow upward into line 46 coupled to the input of the condenser 40. The liquid phase is allowed to flow into a collection line symbolized by dashed line 66 and flows to the acid treatment section of the plant.

Returning to the description of FIG. 3, as shown, the heavier molecular weight compounds which remain in tank 30 (or entering via line 66), are then pumped to a cooling system 70. The cooling system 70 can be any type cooling system which can cool the hot oil stream down to ambient in an acceptable amount of time. The least expensive way of performing this step is pumping the hot heavier oils in line 72 to a settling tank 74 and letting the oil cool naturally in the ambient air. The preferred temperature at which the acid treatment is performed is 100–120° F., so cooling all the way to ambient temperature is not necessary, although the acid treatment could be performed, albeit slower, at ambient temperature. Depending upon the ambient temperature, this cooling process could take from few hours to 2 days. If faster cooling is desired, a heat exchanger or refrigeration system can be used.

After the oil has reached the desired acid treatment temperature, it is pumped or flows by gravity through line 71 to settling tank 74 where sulfuric acid is added. In the batchwise process of FIG. 3, the acid is added directly into tank 74 as symbolized by line 75. Since acid attacks metals, the tank 74 and all pipes and other components which come into contact with the acidified oil or acid sludge must be protected from the acid or made of a material which is impervious to attack. Typically, fiberglass coated steel tanks, pipes, agitators etc. may be used, but teflon or resin coatings may also be used or any other material with sufficient strength, imperviousness to acid, and longevity when exposed to ultraviolet rays of the sun, temperature changes, wind and rain will also suffice.

The desired sulfuric acid concentration for the sulfuric acid is 98% technical grade. The desired concentration in solution is 2%–7% by volume. Prior art acid-clay re-refiners typically used acid concentrations of 5–10%, but this rarely oxidized the undesired compounds and gave quick settling times, so more acid was routinely added. Frequently, the total amount used wound up in the range from 15%–30% by volume. The sulfuric acid can be added manually, or in more automated embodiments, it can be added by a computer controlled mechanism. The entire plant process for all the plant processes shown in FIGS. 3–8 can be automated to save on labor costs at the expense of higher initial capital investment costs.

The acid oxidizes sulfur and the heavy metals such as lead, arsenic, cobalt, cadmium, and zinc. The oxidation process is speeded up by agitating the mixture as symbolized by agitator 77 in FIGS. 3, 5, and 7 since the acid is hydrophilic and does not mix easily with oil and the oil is hydrophobic. The products of this oxidation process settle to the bottom of tank 74 as acid sludge within about 12–24 hours. In the prior art acid clay re-refining process, settling of the acid sludge often took 30 days or more and even then incomplete settling occurred. In an effort to speed up settling, prior art workers often added more acid and concentrations of acid sometimes reached 50% by weight which greatly complicated the acid sludge disposal problem faced by these prior art workers. If the acid sludge does not settle, the tank is then rendered unavailable and the used oil becomes even more hazardous than it was when it arrived. The environmental and economic problems of disposing of acid sludge and acidified used oil this acidic and retrieving the tank for further use were monumental.

After settling is complete, the acid sludge is pumped on line 80 to the process for converting the acid sludge to either hard or soft asphalt or both.

The cleaned up heavier lube stock is pumped on line 90 to polishing tank 92 where the color of the lube stock is corrected and the acid number is reduced by the addition of approximately 10% by volume of activated clay as symbolized by arrow 94. Steam sparging, as symbolized by line 96 may be optionally performed, but is preferred, to agitate the oil, and to help reduce the acid number by vaporizing any remaining acid in the solution. Alternatively, a mechanical agitator 95 may be used instead of steam sparging. The polishing agent and steam sparging combine in the preferred process to reduce the acid number down to 0.05 which is a quality which is absolutely required by customers for re-refined lube stocks. High acid number oils have bad odor since odors usually originate from the acids present in the solution. Therefore, oils with high acid number have suppressed market value since customers do not like oil with bad odor.

The oil with clay in solution is then pumped through a bleaching filter 98 to remove the clay, and the re-refined oil is output on line 100. The bleaching filter is filled with any member of the bleaching earth class such as activated clay, Fuller's earth, activated bauxite, activated carbon, etc. All of these bleaching agents will adsorb dark oxidized particles in solution to lighten the color of the resulting filtered oil. In some embodiments, diatomaceous earth is added as a filtering aid to speed up and/or improve the; filtration process. The process shown in FIGS. 3–4 using a separate tank 92 and filter 98 is a continuous process most well suited for viscous oils such as motor oils. For less viscous used oils such as industrial used oil, a batchwise percolation process could be used where the bleaching agent is placed in the bottom of tank 92 and the oil in line 90 fills the tank and then percolates down through the bleaching agent to the exit line 93.

The re-refined oil output on line 100 is very clean and has lead content which is essentially zero, and in all instances much lower than the 100 ppm U.S. Environmental Protection Agency standard and far below the California EPA standard of 50 ppm. The sulfur content of the re-refined oil output on line 100 is also very low since the acid treatment in tank 74 removes substantially all the sulfur in the acid sludge free oil output on line 90. The re-refined oil output on line 100 also has a very low or non-existent water and chlorinated compounds content since the water and chlorinated compounds have boiling points down around 140° F.

to 350° F. and are all vaporized and removed in the first heating step in tank 30 where the used oil temperature is raised above 725° F. The re-refined oil output on line 100 is also very commercially valuable as it sells for anywhere from $0.80 to $1.20 U.S. per gallon.

The clay cake from the filter is then put into a kiln 102 where it is dried and recycled as symbolized by line 104. The clay cake can also be used for other purposes such as making bricks or filler for other clay based products.

The process for converting the acid sludge on line 80 to soft or hard asphalt that can be sold while simultaneously completely eliminating the monumental environmental problem of acid sludge disposal is fully described in a United States Patent Application entitled A PROCESS FOR CONVERTING ACID SLUDGE TO INTERMEDIATE SLUDGE AND SOFT No. AND/OR HARD ASPHALT, Ser. No. 08/197587 filed Feb. 2, 1994 now U.S. Pat. 5,470,455, which was a continuation in part of U.S. patent application, entitled A PROCESS FOR CONVERTING ACID SLUDGE TO INTERMEDIATE SLUDGE, Ser. No. 07/879,642, filed May. 7, 1992, now U.S. Pat. No. 5,288,392, both of which are hereby incorporated by reference.

In summary, the process for converting acid sludge into soft or hard asphalt is as follows. The first step in this process is to raise the pH of the acid sludge. This is done by altering the pH of the acid sludge by adding a pH elevating agent to the acid sludge. In FIGS. 3–8, this is done in tank 106 with agitator 110 thoroughly mixing the pH alteration agent with the acid sludge. The preferred way of raising the pH of the acid sludge is to place the acid sludge in a fiberglass lined tank (or any acid resistant coated tank) and then add a quantity of water and mix the solution thoroughly and measure the pH. Then, if the pH is not high enough, removing the water and adding fresh water and mixing the mixture again and re-measure the pH. This process is repeated until the pH rises to approximately 3–7. An alternative method is to place the acid sludge on a roller or any grinding/shearing/tumbling apparatus and adding water continuously while simultaneously draining excess water as the acid sludge is agitated. The amount of water generally needed depends upon the amount of acid used, but is usually 5–10 parts of water to one part of acid sludge.

The pH elevating agent, symbolized by arrow 108, has a pH ranging from 3–14. The volume and pH of the pH elevating agent entering tank 106 on line 108 are selected so as to be sufficient to raise the pH of said acid sludge to a range from approximately 3 to approximately 7. The pH of the acid sludge must be raised to a level such that the acid sludge does not become sandy and un-meltable at temperatures from room temperature up to approximately 275° C. This pH elevation process creates mixture in tank 106 comprising a layer of liquid and a layer of intermediate sludge having a pH in the range from 3–7.

Generally any pH elevating agent may be mixed with the acid sludge in tank 106 to raise its pH, although there are some restrictions. Generally, the preferred agents are water, acid of a higher pH, or weak or strong bases and salt solutions in that order. Solid pH elevation agents may also be used such as lime, caustic soda, or soda ash, or any other inorganic solid with a pH higher than 3 after said solid pH elevating agent is dispersed or dissolved in any solvent such as water. Generally, solid pH elevating agents may be added either alone or they may be first dissolved or dispersed in solvent and then added. Dissolving or dispersing the solid pH elevating agent in a liquid helps disperse the agent better, but is not absolutely essential because one by-product of reacting a base such as lime, caustic soda, or soda ash with an acid is water, so there will be some liquid to help disperse the pH elevating agent and dissolve it anyway even if the solid base is not first dissolved in a solvent.

The pH elevating agent must be thoroughly mixed with the acid sludge to effectively raise its pH. This can be done by using two steel, fiberglass coated rollers in a "wringer" arrangement such as is found on early washing machines. The acid sludge stream and the pH elevating agent stream are then introduced into the junction between the rollers and a mixing/shearing action occurs. The preferred method is to put the acid sludge into tank 106 and then put the pH elevating agent in the tank also and agitate the mixture thoroughly with a steel, fiberglass coated propeller 110 or other mixing structure while heating the mixture slightly with heater 109 to lower its viscosity. Heater 109 may be powered by the light ends hydrocarbons generated in the first heating step, or may be supplied with fuel/electricity from an external source as symbolized by line 111. An alternative arrangement is to use an in-line mixer such as an auger inside a sleeve as the input conduit to tank 106. In this arrangement, the acid sludge on line 80 and the pH elevating agent on line 108 are each fed proportionately in the correct ratio into the input end of the auger and a shearing/mixing action occurs as the mixture is augered into the tank 106. The correct proportions of acid sludge and pH elevating agent are dependent upon the concentration of the pH elevating agent and the volume of the acid sludge flow and may be determined experimentally. Where water is used as the pH elevating agent, approximately 5–10 parts of water to one part of acid sludge is used.

The preferred pH elevating agent is water. When mixed with the acid sludge on line 80, the mixture in tank 106 has two layers, i.e., a top layer of mostly water and some liquid soluble acid sludge components and a bottom layer of intermediate sludge. Separation of the top water layer can be performed by any known means such as decanting,, pumping the water layer out, etc.

Soft asphalt is refined in tank 106 by heating the mixture after removal of the water layer to between 100°–275° C., preferably between 200°–275° C., and holding the mixture at this temperature long enough to evaporate the remaining water content of the intermediate sludge to convert it to soft, unoxidized asphalt. The heater 108 to do this heating may be powered with the light ends on line 44 or from an external energy supply.

Hard, oxidized asphalt that is commercially known as "blown asphalt" may also be created. Both soft and hard asphalt are valuable by products. Typically, asphalt sells for about $60–$120 per ton. The process to convert soft asphalt to "blown asphalt" is known in the prior art. However, a process to create soft or hard asphalt from acid sludge is not known in any prior art of which the applicant is aware.

Soft, un-oxidized asphalt are useful in road paving and underlaying or undersealing applications, for vapor barrier and as raw material for the creation of blown asphalt.

Different species of soft, un-oxidized asphalt can also be created by adding various additives as symbolized by line 128. Specifically, virgin asphalt stocks can be added to widen the applications of the resulting un-oxidized asphalt such as for use in road paving, rust preventive coatings, etc. Further, the un-oxidized asphalt, either with or without the addition of virgin asphalt stocks, can be made into a wide variety of other products by the addition of various additives. For example, rubber or rubber compounds, e.g., from discarded tires, can be added to produce rubberized asphalt which is useful in waterproofing applications and in road paving.

Further, resins or other classes of polymers can be added to the un-oxidized asphalt to enhance the quality of the resulting soft asphalt such as increasing its adhesion property. Also, solvents can be added to the un-oxidized asphalt to produce cutback asphalt which is useful as a primer for road pavement. Water and emulsifier can be added simultaneously to produce emulsified asphalt which is also useful as primer or sealer for road pavement. Hard or oxidized ("blown") asphalt can also be created by oxidizing the soft asphalt generated from the acid sludge in accordance with the above described process. Generally this process involves heating the intermediate sludge in tank 106 to 200°–270° C., preferable 230° C. to remove any remaining water in the soft asphalt, and blowing air through the soft asphalt for approximately 10–20 hours. The air flow rate is preferably 50 cubic feet per minutes. Higher air flow rates or higher temperatures shorten the time necessary to produce "blown asphalt." The preferable penetration number indicative of the desired hardness of the resulting asphalt is 6–25, but higher penetration numbers are also useful. For example, penetration numbers up to 100 are also useful species of this type of asphalt. Blown asphalt is typically used in roofing and other waterproofing or waterproof coating applications. In FIG. 3, valve 112 is shown for controlling the amount of soft asphalt output on line 114 that is directed into the hard asphalt oxidizing tank 116. Of course if only hard asphalt is to be made, it can be made in tank 106, and there is no need for tank 116. In this case, tank 106 is provided with air sparging facilities symbolized by line 118 by which air may be bubbled through the asphalt. Also, if soft asphalt is to be made, but it is desired to lower the penetration number thereof, air sparging facilities 118 coupled to tank 106 may be used.

If both soft and hard asphalt are to be made, some of the soft asphalt output on line 114 is directed into tank 116 via valve 112 and line 120. There, the soft asphalt is heated to 200°–275° C. via heater 122 and air is bubbled through the asphalt for an adequate time to get the desired penetration number as represented by air sparging line 123. Heater 122 may be supplied with energy from the light ends generated in the first heating step. The blown asphalt is output on line 124. Line 126 represents the process of adding any needed additives to alter the qualities of the hard asphalt such as ductility etc. for wider applications. For example, rubber or ground up rubber tires may be added to create rubberized asphalt or virgin asphalt can be added to alter the qualities of the resulting asphalt. Also, resins or other additive to increase the adhesion of the resulting asphalt may be added. Likewise, emulsifying agents may be added to the asphalt to create asphalt emulsions, or solvent may be added to create cutback asphalt. These same additives may be optionally added to tank 106 to alter the qualities or properties of the soft asphalt output on line 114 or to create other products on line 114 such as emulsified asphalt or cutback asphalt.

Approximately 10%–15% of the volume of input used oil on line 32 is converted to asphalt.

Figure 4:
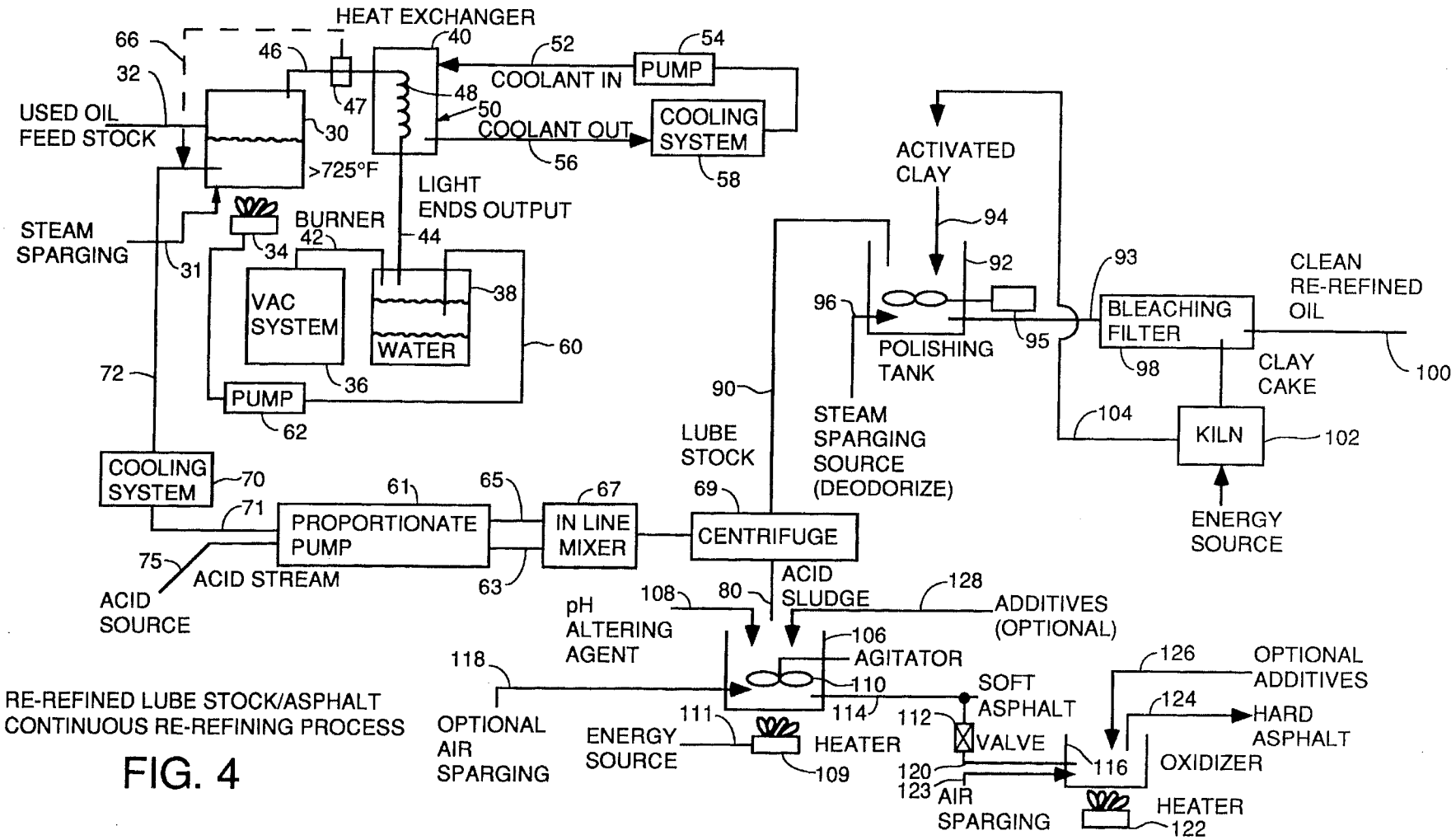
FIG. 4 is a process flow diagram of a continuous flow plant for refining clean re-refined oil from used oil having chlorine content below the EPA 1000 PPM upper limit and low sulfur content including a process to convert any acid sludge created to soft and/or oxidized asphalt.

FIG. 4 is a process flow diagram of a continuous flow plant for refining clean re-refined oil from used oil having chlorine content below the EPA 1000 PPM upper limit and low sulfur content including a process to convert any acid sludge created to soft and/or hard oxidized asphalt. Components having the same reference numbers in FIG. 4 as in FIG. 3 are the same structures as previously described and have the same, functional equivalents some of which have been previously described. The main differences between the plants of FIG. 3 and FIG. 4 are that the acid stream in line 75 is pumped in a proportionate pump 61 as an output stream on line 63 while the dehydrated oil on line 71 is pumped in the proportionate pump 61 and output on line 65. The proportionate pump pumps enough acid out on line 63 to properly raise the pH of the dehydrated oil for the flow volume on line 71, i.e., 3 to 7% $H_2SO_4$ by volume. These output lines 63 and 65 are input to an in-line mixer 67 where the acid stream and the dehydrated oil are mixed. The resulting mixture is then spun in centrifuge 69 to separate the lube stock from the acid sludge. The lube stock is output on line 91 and the acid sludge is output on line 80. From there, the process is the same as previously described in FIG. 3 for generation of both re-refined lube oil and soft and hard asphalt.

Figure 5:
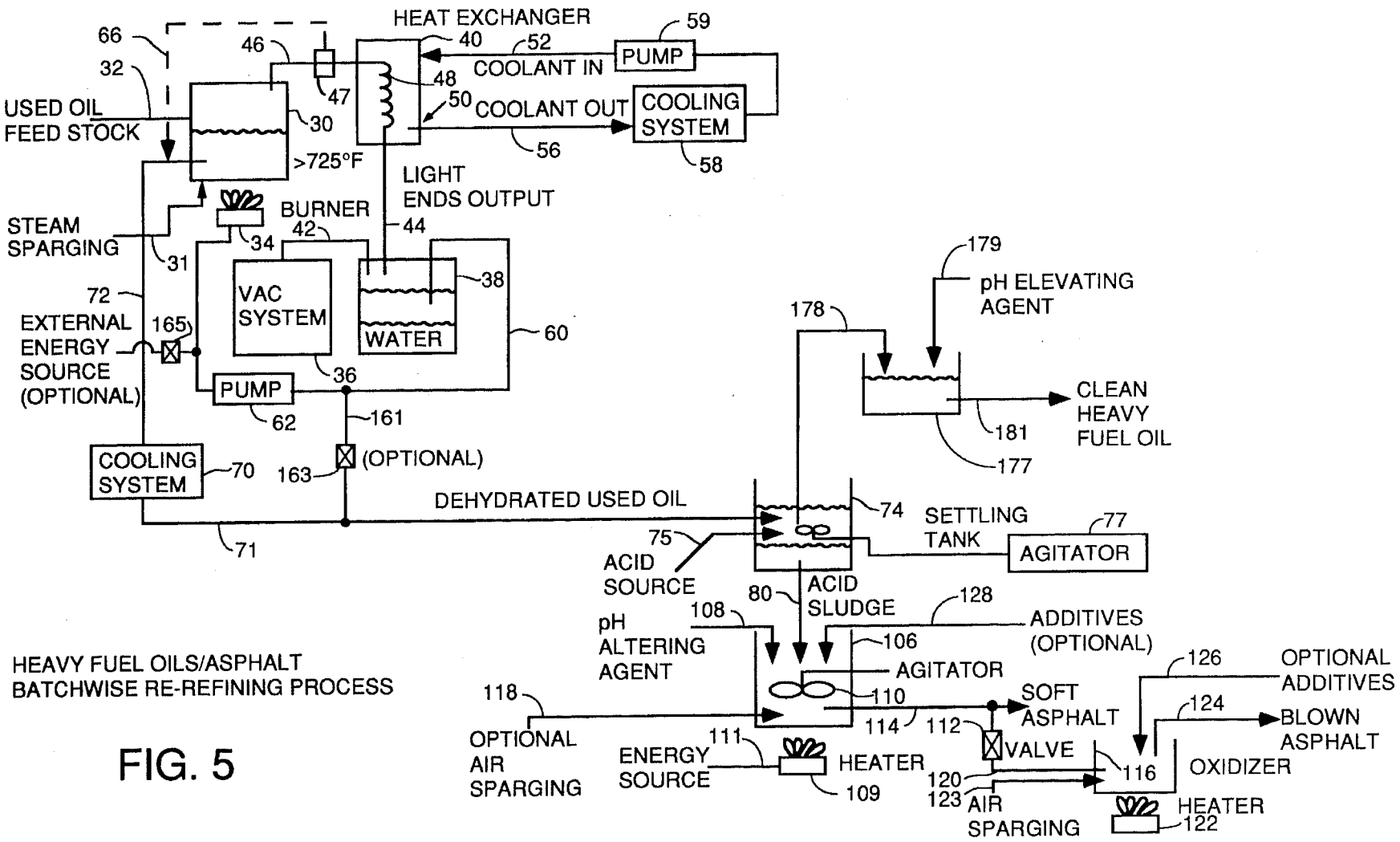
FIG. 5 is a process flow diagram of a simple batchwise plant for refining clean heavy fuel oil from used oil having chlorine content below the EPA 1000 PPM upper limit and low sulfur content including a process to convert any acid sludge created to soft and/or oxidized asphalt.

FIG. 5 is a process flow diagram of a simple batchwise plant for re-refining clean heavy fuel oil from used oil having chlorine content below the EPA 1000 PPM upper limit and low sulfur content including a process to convert any acid sludge created to soft and/or hard, oxidized asphalt. This process is substantially similar to the process of re-refining lube stocks defined above except the final steps of polishing with activated clay to color correct the refined product and steam sparging to deodorized it and then filtering out the clay are not needed. Therefore, the polishing tank 92, filter 98 and kiln 102 are eliminated. The basic process to make clean, heavy fuel oils includes the first step of heating the used oil feed stock to a temperature above 725° F. to dissociate the additives, especially to destroy the effectiveness of the dispersants. This is done in tank 30 in the same manner as described above with reference to FIG. 3. The light end products and water are collected in tank 38. The light end products can be pumped to the burner 34 via pipe 60 and pump 62 to supply the energy needs of the first heating step. Optionally, if a lower viscosity fuel oil is desired, the light end products can be pumped through line 161 and valve 163 into the output line 71 of the cooled heavier dehydrated oils left after the heating step in tank 30 is completed. If valve 163 is opened, the heater 34 must be supplied from an external energy source through valve 165.

The combined oils or only the heavier dehydrated oils on line 71 flow to tank 74 where there are mixed with sulfuric acid in the same manner as described with reference to FIG. 3 to remove the heavy metals, carbonaceous products and everything else which will be oxidized by sulfuric acid. All these unwanted materials will settle out as acid sludge within 24 hours, and usually within 12 hours. In addition, any chlorinated compounds originally present in the feed stock on line 32 will have already been removed in the first heating step because of their low boiling points. The resulting fuel oil in tank 74 is then moved to a pH correction tank 177 where a pH correction solution on line 179 is put in the tank to neutralize the pH of the re-refined fuel oil which is output on line 181. The acid sludge is removed from tank 74 on line 80 and processed as previously described to generate soft and/or hard asphalt, asphalt emulsion, cutback asphalt, rubberized asphalt, etc.

Figure 6:
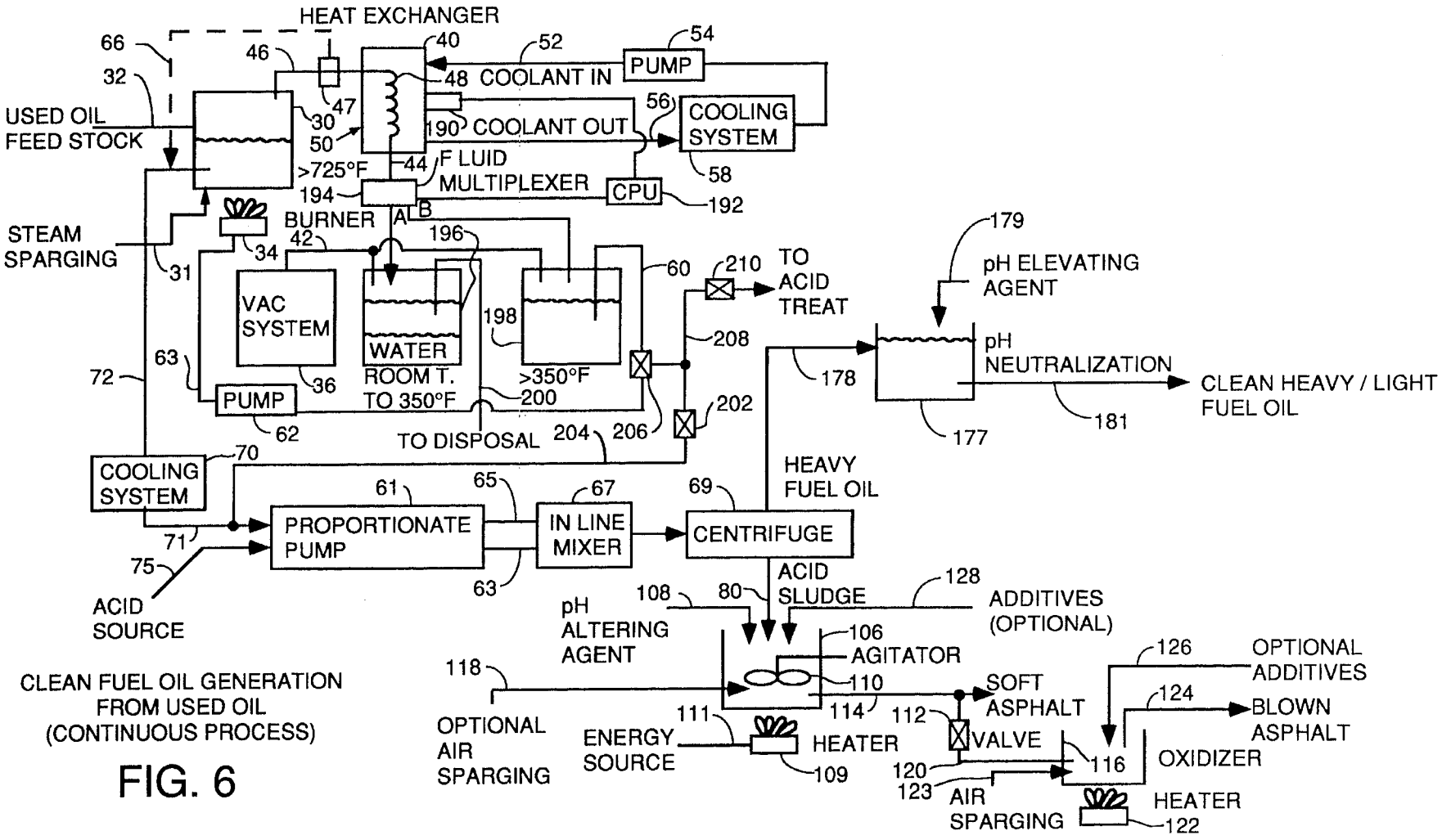
FIG. 6 is a process flow diagram of a slightly more complex continuous process plant to refine clean heavy/light fuel oil from used oil having a chlorine content above the EPA 1000 PPM upper limit with the capability to use the light end products to supply the plants heating needs or to mix the chlorine free light ends in with the heavier compounds being acid treated to remove the heavy metals and additives, with an additional process to convert the acid sludge into either soft, unoxidized asphalt or oxidized, hard asphalt or some of each.

FIG. 6 is a process flow diagram of a slightly more complex continuous process plant to re-refine clean heavy/light fuel oil from used oil on line 32 having a chlorine content above the EPA 1000 PPM upper limit with the capability to use the light end products to supply the plants heating needs or to mix the chlorine free light ends in with the heavier compounds being acid treated to remove the heavy metals and additives, with an additional process to convert the acid sludge into either soft, unoxidized asphalt or oxidized, hard asphalt or some of each. The plant of FIG. 6 makes use of the fact that the chlorinated compounds have much lower boiling points than the light end hydrocarbons to eliminate these chlorinated compounds. This is done in the first heating step performed in tank 30. This first heating step is the same as described with reference to FIG. 3, but the processing of the vapors liberated from the feed stock is different. Since the chlorinated compounds and water have boiling points down around 140° F. to 350° F. while the light ends have boiling points above 350° F., separation of the undesired water and chlorinated compounds from the desired light end fuels is accomplished in the heat exchanger 40. As the feed stock is heated to a temperature above 725° F., all the water, chlorinated compounds and light end hydrocarbons are vaporized. In the heat exchanger 40, these vapors are cooled gradually from a temperature above 725° F. down to the temperature of the coolant in line 52. A temperature sensor 190 coupled to a computer 192 senses the temperature inside the condensation coil 48. The computer 192 is coupled to a fluid multiplexer 194 which has a single input44 and two fluid outputs marked A and B. When the temperature inside the condenser is between 350° F. and whatever temperature to which the feed stock has been heated, the fluid multiplexer diverts all condensate leaving the condenser coil on line 44 via output line B into light ends collection tank 198. When the temperature inside the condenser is between room temperature (or the temperature of coolant on line 52) and 350° F., the fluid multiplexer diverts all condensate leaving the condenser coil on line 44 via line A into water and chlorinated compounds collection tank 196. These chlorinated compounds can be pumped into disposal barrels via line 200 for incineration or other acceptable disposal methods. The light ends collected in tank 198 may be pumped via line 60 and valve 206 back to burner 34 via pump 62 and line 64, or they may be pumped into the heavier dehydrated oil stream on line 71 via valves 206 and 202 and line 204 if lower viscosity fuel oils are to be generated. If both light and heavy fuel oils are to be generated, the light ends may be pumped via line 60, valve 206, line 208 and valve 210 to an acid treatment facility (not shown) like that shown in FIG. 3 to remove the heavy metals, and carbonaceous products as acid sludge. The acid sludge generated in this process may be joined with the acid sludge generated on line 80 from the centrifuge 69 to generate saleable asphalt products.

Figure 7:
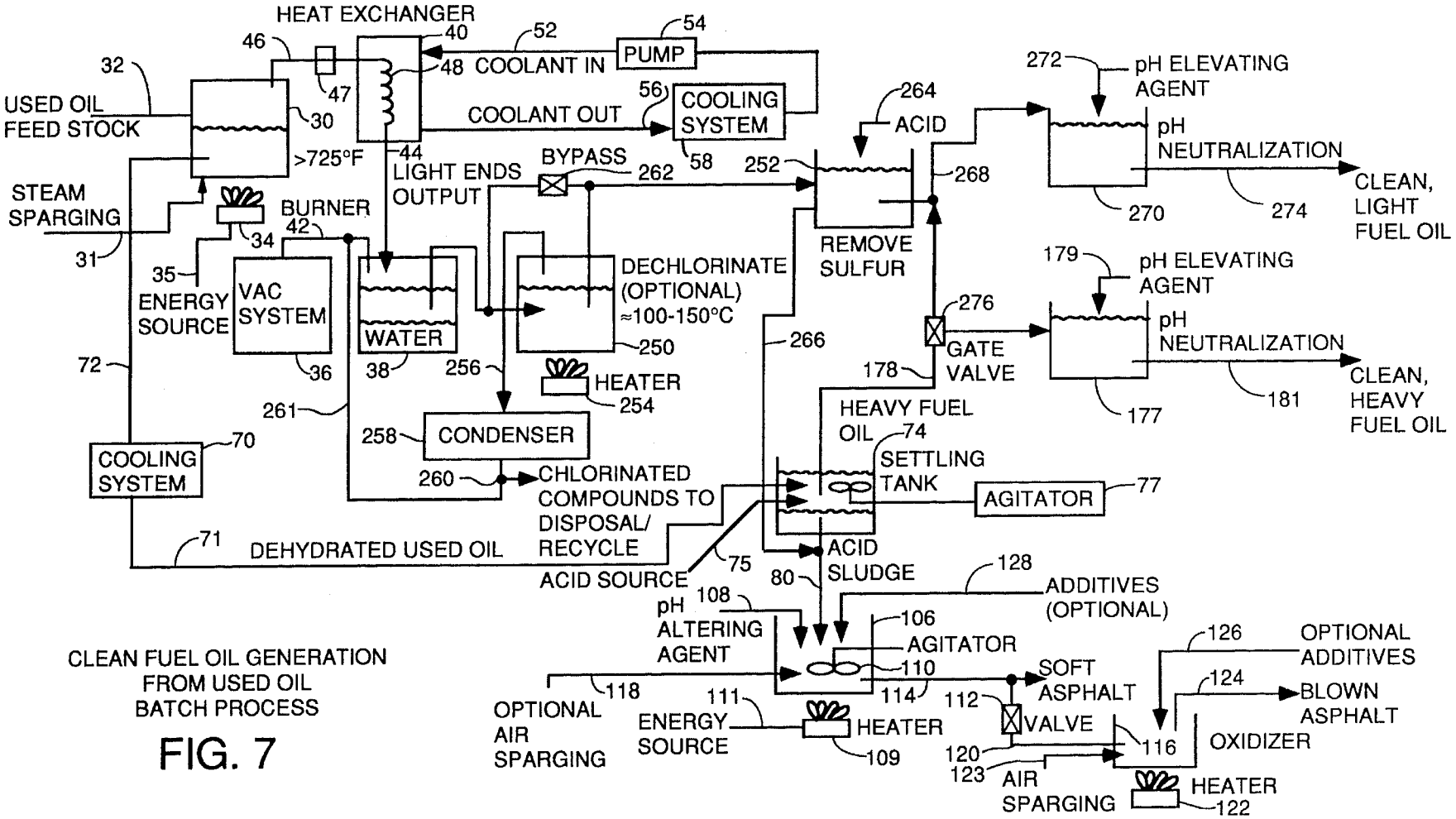
FIG. 7 is a process flow diagram of a more complex batch process plant to refine, clean heavy and light fuel oils from used oil having a chlorine content above the EPA 1000 PPM upper limit with an additional process to convert the acid sludge into either soft, unoxidized asphalt or oxidized, hard asphalt or some of each.

FIG. 7 is a process flow diagram of a more complex batch process plant to refine, both clean heavy and clean light fuel oils from used oil having a chlorine content above the EPA 1000 PPM upper limit and with a high sulfur content with an additional process to convert the acid sludge resulting from the process of refining fuel oils into either soft, unoxidized asphalt or oxidized, hard asphalt or both or other asphalt products. All structures having the same reference numbers as structures previously described are identical in structure and serve the same purpose in the combination of process steps. In the process of FIG. 6, the light ends generated in the first heating step in tank 30 are used as feed stock for the process to make clean light fuel oils. The first heating step is as previously described for the process of FIG. 3 causing light ends, water and chlorinated compounds to condense in heat exchanger 40 and flow into tank 38. Heater 34 is supplied from some external energy source via line 35. The light ends are separated from the water in tank 38 by decanting etc. and pumped into tank 250. Assuming that the feed stock on line 32 has chlorinated compounds therein above acceptable limits set by environmental authorities, and also has a high sulfur level, these components are removed from the light ends in tanks 250 and 252. The chlorinated compounds are removed by heating the contents of enclosed tank 250 to a temperature between 100° C. and 150° C., using heater 254. This causes the chlorinated compounds to boil and leave solution as a vapor on line 256 under the influence of vacuum applied to tank 250 via line 261 from the vacuum system 36 to the output line of the condenser 258. The vapors of the chlorinated compounds are condensed in condenser 258 and leave the system via line 260 for incineration or other environmentally safe disposal. If chlorinated compounds above acceptable limits are not present in the feed stock on line 32 but unacceptably high sulfur values are present that must be removed to avoid the unpleasant smell which results when such fuel oil is burned, bypass valve 262 may be opened to bypass tank 250. The condensed light ends are then pumped to tank 252 where sufficient sulfuric acid is added via line 264 to oxidize the sulfur. The sulfur and sulfur compounds settle out of solution within 24 hours as acid sludge is then removed to the asphalt formation process previously described via line 266. The acid sludge on line 266 is added to the acid sludge on line 80 as the feedstock for the asphalt formation process. The light ends, less the sulfur and sulfur compounds, are pumped via line 268 to pH neutralization tank 270 where the pH of the light fuel oil is adjusted to approximately 7 by the addition of liquid pH elevating agent via line 272. The preferred pH elevating agent on lines 272 and 179 can be any soluble solution of pH substantially greater than 7 which does not create solids, water or precipitates in the fuel oil. Typically, these preferred pH elevating agents are from the amine group such as the ethanolamines, e.g., monoethanolamine, diethanolamine. However, caustic solution or other inorganic basic solutions can be used coupled with filtering or gravitational sedimentation to remove any solids or precipitates followed by evaporation, pumping out or decanting etc. to separate the fuel oil layer from any water layer generated by the addition of the base to the acid.

The pH altered clean, light fuel oils are pumped out for sale on line 274. Gate valve 276 may be opened to join the light fuel oil stream on line 268 with the heavy fuel oil stream on line 178 if a lower viscosity fuel oil is desired for output on line 181. The process for generating clean, heavy fuel oil on line 181 is as previously described.

Figure 8:
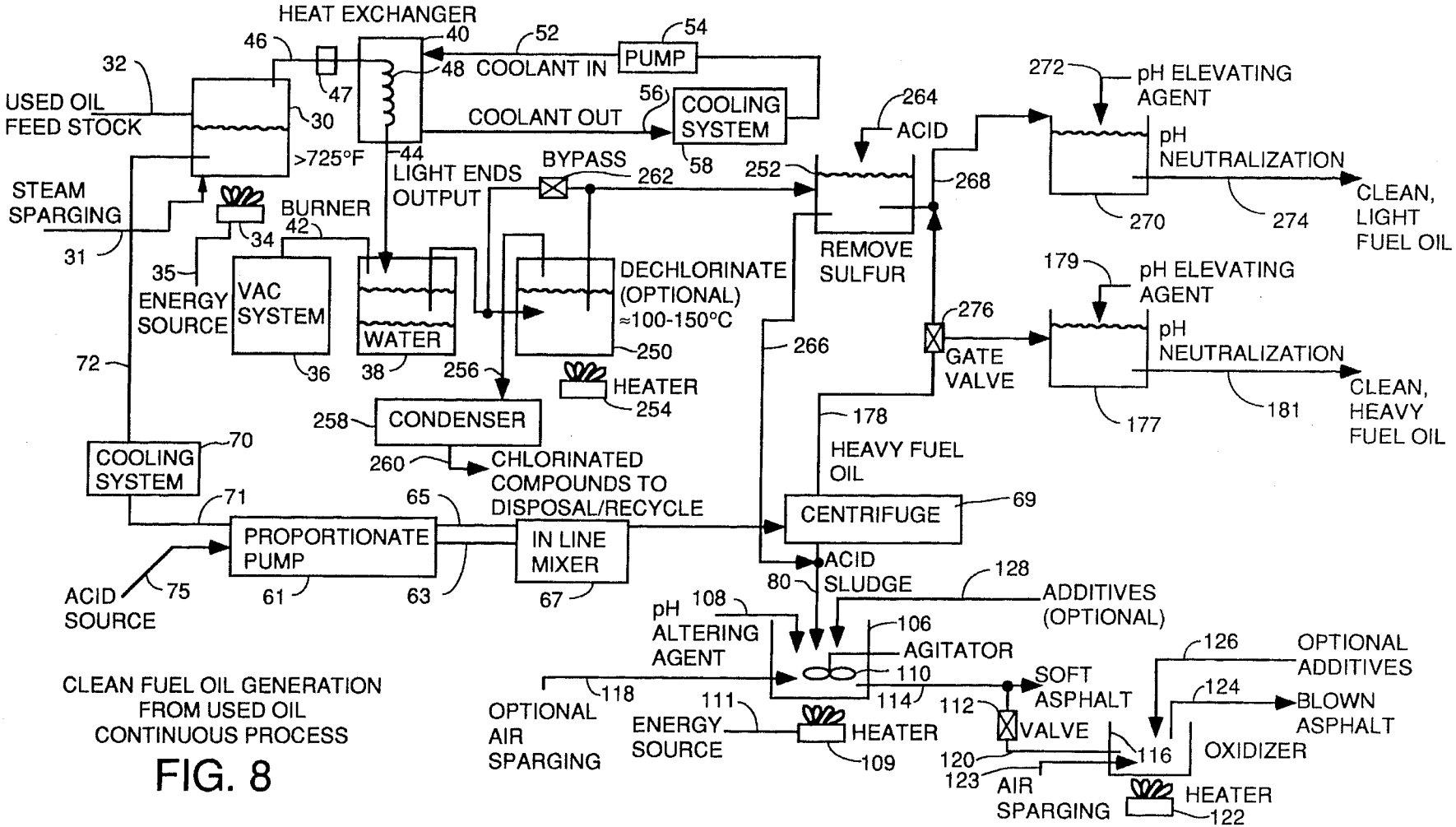
FIG. 8 is a process flow diagram of a more complex continuous process plant to refine clean heavy and light fuel oils from used oil having a chlorine content above the EPA 1000 PPM upper limit with an additional process to convert the acid sludge into either soft, unoxidized asphalt or oxidized, hard asphalt or some of each.

FIG. 8 is a process flow diagram of a more complex continuous process plant to refine clean heavy and light fuel oils from used oil having a chlorine content above the EPA 1000 PPM upper limit and unacceptably high sulfur content in the feed stock with an additional process to convert the acid sludge into either soft, unoxidized asphalt or oxidized, hard asphalt or some of each or other asphalt products. The structures in FIG. 8 having the same reference numbers as structures in FIG. 7 have the same structure and purpose in the combination. The only difference between FIGS. 7 and 8 is that the plant in FIG. 8 is a high volume continuous flow plant using proportionate pump 61, in-line mixer 67 and centrifuge 69 to continuously process the heavy, dehydrated fuel oils leaving tank 30 in a continuous flow fashion. These components have the same structure and purpose as components with like reference numbers in FIGS. 6 and 4.

There follows several examples of the process of re-refining lube stocks.

EXAMPLE 1.

Samples of used automotive crankcase oil were obtained for use in the process of the present invention. One of the two samples is identified as Used Oil I, the other is identified as Used Oil II. The initial chemical properties of the used oil were measured and are listed below in Table I. Eight aliquots were removed from Used Oil I. Each aliquot or sample was then subjected to the present process. The temperature was varied with each sample: Two of the eight samples were heated to 350° F; two were heated to 550° F; two were heated to 650° F; and two were heated to 850° F. In addition, the volume of 98% $H_2SO_4$ added to each sample was varied. One sample at each temperature contained 5% $H_2SO_4$ and the other sample contained 10% $H_2SO_4$. At intervals of one, two and three days a measurement was taken to determine the percent of acid sludge which had settled. The results are listed in Tables I and II.

TABLE I

| CHARACTERISTICS | USED OIL I | USED OIL 2 |
|---|---|---|
| Color | Brownish/Black | Black |
| Odor | burnt with diesel odor | Burnt |
| A.P.I. gravity at 60/60 F, ASTM D287 | 23.2 | 24.3 |
| Viscosity, 100° F., SSU | 275 | 350 |
| Water, ASTM D95 | 0.2% | 1.0% |
| Pentane insoluble ASTM D893 | 2.0% | 3.0% |

TABLE II

| CHARACTERISTICS | CONDITIONS | | | | | | | |
|---|---|---|---|---|---|---|---|---|
| Dehydration/ Fractionation Temperature F. | 350 | | 550 | | 650 | | 850 | |
| Acid Strength % | 98 | | 98 | | 98 | | 98 | |
| Acid Dosage, % | 5 | 10 | 5 | 10 | 5 | 10 | 5 | 10 |
| % Acid Sludge Settled v. the ff. settling time | | | | | | | | |
| 1 day | 0 | 20 | 10 | 25 | 30 | 50 | 85 | 100 |
| 2 days | 5 | 30 | 15 | 35 | 50 | 60 | 100 | 100 |
| more than 3 days | 5 | 30 | 15 | 40 | 60 | 75 | | |
| Reclaimed Oil: | | | | | | | | |
| Color, ASTM D1500 | — | — | — | — | D8 | 7.5 | 2.5 | 2.5 |
| Viscosity, 100° C., cst, ASTM D445 | — | — | — | — | 7.0 | 7.0 | 7.0 | 7.0 |

As indicated in Table II, after more than three days, only 30% of the acid sludge had settled in the 10% $H_2SO_4$, 350° F. sample. Moreover, only 5% of the 5% $H_2SO_4$, 350° F. sample had settled after three days. In addition, the color of the oil could not be measured, because it was too dark and the viscosity could not be obtained because of the presence of unsettled sludge. However, at 650° F. and 850° F. significant improvements in these properties were observed. For example, when the oil was processed at 850° F., 100% of the acid sludge had settled in just one day for the 10% $H_2SO_4$ sample, and 100% of the 5% $H_2SO_4$ oil had settled after only two days. In addition, the color of the oil was 2.5 and the viscosity at 100•C. was 7.0 centistokes.

EXAMPLE 2.

Used Oil II was processed according to the process described in Example 1 regarding Used Oil I. Similar results were obtained for Used Oil II as indicated in Table III.

TABLE III

| CHARACTERISTICS | CONDITIONS | | | | | | | |
|---|---|---|---|---|---|---|---|---|
| Dehydration/ Fractionation Temperature F. | 350 | | 550 | | 650 | | 850 | |
| Acid Strength % | 98 | | 98 | | 98 | | 98 | |
| Acid Dosage, % | 5 | 10 | 5 | 10 | 5 | 10 | 5 | 10 |
| % Acid Sludge Settled v. the ff. settling time | | | | | | | | |
| 1 day | 0 | 15 | 10 | 20 | 50 | 75 | 100 | 100 |
| 2 days | 5 | 25 | 10 | 30 | 80 | 90 | 100 | 100 |
| more than 3 days | 10 | 30 | 15 | 40 | 80 | 90 | | |
| Reclaimed Oil: | | | | | | | | |
| Color, ASTM D1500 | — | — | — | — | D8 | 7.0 | 2.5 | 2.5 |
| Viscosity, 100° C., cst, ASTM D445 | — | — | — | — | 6.2 | 6.2 | 6.2 | 6.2 |

The following methods (which can be found in Appendices A-E) from the American National Standard Institute and the American Society for Testing and Materials, were used to obtain values set forth in Examples 1 and 2:

1. ANSI/ASTM D 287, Standard Test Method for API GRAVITY OF CRUDE PETROLEUM AND PETROLEUM PRODUCTS (HYDROMETER METHOD), pp. 187–190 (1977).
2. ANSI/ASTM D 95, Standard Test Method for WATER IN PETROLEUM PRODUCTS AND BITUMINOUS MATERIALS BY DISTILLATION, pp. 59–63 (1970, Reapproved 1980).
3. ANSI/ASTM D 893, Standard Test Method for INSOLUBLES IN USED LUBRICATING OILS., pp. 395–401 (1980).
4. ANSI/ASTM D1500, Standard Test Method for ASTM COLOR OF PETROLEUM PRODUCTS (ASTM COLOR SCALE), pp 803–806 (1964, Reapproved 1977).
5. ANSI/ASTM D 445, Standard Test Method for KINEMATIC VISCOSITY OF TRANSPARENT AND OPAQUE LIQUIDS (AND THE CALCULATION OF DYNAMIC VISCOSITY), pp. 243–248 (1979).

What is claimed is:

1. A process for converting acid sludge to asphalt comprising:

raising the pH of said acid sludge to a target pH in the range from 3 to 7 by mixing a pH elevating agent including at least water with said acid sludge, said target pH being high enough that said acid sludge does not become sandy and un-meltable at temperatures from approximately from 70° F. up to approximately 275° C., thereby creating a mixture comprising a layer of mostly water and a layer of intermediate sludge;

separating said intermediate sludge from substantially all said water thereby creating a body of intermediate sludge with some water content;

performing a low temperature heating step by heating said intermediate sludge to a temperature between 100° C. to 275° C. for a time long enough to remove the remaining water content thereby creating soft asphalt.

2. The process of claim 1 wherein said step of raising said pH comprises the steps of:

placing the acid sludge in an acid resistant tank;

adding water in the tank in the proportion of 5–10 parts water to one part acid sludge to form a mixture of water and acid sludge;

mixing the mixture thoroughly;

measuring the pH;

if the pH is not high enough, removing the water and adding fresh water;

mixing the mixture again and re-measuring the pH; and repeating the foregoing process until the pH rises to approximately 3–7.

3. The process of claim 1 wherein said step of raising the pH said acid sludge is accomplished by adding in addition to water either a pure solid pH elevating agent selected from the group consisting of caustic soda, lime or soda ash or by dispersing said solid pH elevating agent in a liquid solution and adding the solution to the acid sludge, and then agitating the resulting mixture.

4. The process of claim 2 wherein said mixture of acid sludge and pH elevating agent are heated during mixing to lower the viscosity of the mixture.

5. The process of claim 1 wherein said low temperature heating step further comprises the steps of:

heating said soft asphalt to a temperature between 200° C. and 275° C., preferably 230° C. and bubbling air through the mixture for between 10–20 hours to generate hard oxidized asphalt.

6. The process of claim 2 wherein said low temperature heating step further comprises the steps of:

heating said soft asphalt to a temperature between 200° C. and 275° C., preferably 230° C. and bubbling air through the mixture for between 10–20 hours to generate hard oxidized asphalt.

7. The process of claim 4 wherein said low temperature heating step further comprises the steps of:

heating said soft asphalt to a temperature between 200° C. and 275° C., preferably 230° C. and bubbling air through the mixture for between 10–20 hours to generate hard, oxidized asphalt.

8. A process for converting acid sludge to asphalt comprising:

raising the pH of said acid sludge to a target pH in the range from 3 to 7 by mixing a pH elevating agent including at least water with said acid sludge, said target pH being high enough that said acid sludge does not become sandy and un-meltable at temperatures from approximately 25° C. up to approximately 275° C., thereby creating a mixture comprising a layer of mostly water and a layer of intermediate sludge;

separating said intermediate sludge from substantially all said water thereby creating a body of intermediate sludge with some remaining water content;

performing a low temperature heating step by heating said intermediate sludge to a temperature between 100° C. to 275° C. for a time long enough to remove the remaining water content thereby creating soft asphalt;

and wherein said low temperature heating step further comprises the step of heating said soft asphalt to a temperature between 200° C. and 275° C., preferably 230° C. and bubbling air through the mixture at a selected flow rate for a selected time where said selected flow rate and said selected time are chosen to obtain a desired penetration number, between 6 and 100.

9. A process comprising the steps of:

(1) providing used oil having impurities including one or more of, water, chlorinated compounds, carbonaceous compounds, metals, oxidizable components and light ends and additives including dispersant additives therein, (2) generating a quantity of dehydrated oil by performing a high temperature heating step by heating the oil to a temperature greater than about 650 degrees Fahrenheit and less than or equal to 1000 degrees Fahrenheit for a time sufficient to dissociate at least said dispersant additives and sufficient to remove water, light ends and chlorinated compounds having boiling points below 650° F., (3) cooling the oil, (4) adding a sufficient amount of acid or other oxidizing agent of a concentration and amount adequate to oxidize substantially all carbonaceous materials, metals and other oxidizable impurities and other undesired components in said used oil so as to generate oxidized products and cause the oxidized products to settle out of solution as acid sludge within one to three days, and preferably within 12–24 hours, so as to create a resulting mixture comprising a layer of acid sludge and a layer of oil which is substantially free of acid-sludge, (5) after substantially all acid sludge has settled out of solution, separating the acid sludge from the substantially acid-sludge-free oil, (6) adding a polishing agent to said acid-sludge-free oil, and steam sparging said acid-sludge-free oil to deodorize it, lighten the color thereof and raise the pH to a neutral value;

(7) filtering said acid-sludge-free oil to remove spent polishing agent to create re-refined lubricating oil;

(8) raising the pH of said acid sludge to a target pH in the range from 3 to 7 by mixing a pH elevating agent including at least water with said acid sludge, said target pH being high enough that said acid sludge does not become sandy and un-meltable at temperatures from approximately 70° F. up to approximately 275° C., thereby creating a mixture comprising a layer of mostly water and a layer of intermediate sludge;

(9) separating said intermediate sludge from substantially all said water thereby creating a body of intermediate sludge with some remaining water content;

(10) performing a low temperature heating step by heating said intermediate sludge to a temperature between 100° C. to 275° C. for a time long enough to remove the remaining water content thereby creating soft asphalt.

10. The process of claim 8 further comprising the steps of creating the acid sludge according to the following process:

(1) providing used oil having impurities including one or more of water, chlorinated compounds, carbonaceous compounds, metals, oxidizable components and light ends and additives including dispersant additives therein, (2) generating a quantity Of dehydrated oil by performing a high temperature heating step comprising heating the oil to a temperature greater than 650 degrees Fahrenheit and less than or equal to 1000 degrees Fahrenheit for a time sufficient to dissociate at least said additives and to remove water and light ends and chlorinated compounds having boiling points below 650° F., (3) cooling the oil, (4) adding a sufficient amount of acid or other oxidizing agent of a concentration and amount adequate to oxidize substantially all carbonaceous materials, metals and other oxidizable impurities and other undesired components in said used oil to generate oxidized products and cause the oxidized products to settle out of solution as acid sludge within one to three days, and preferably within 12–24 hours, so as to create a resulting mixture comprising a layer of acid sludge and a layer of substantially acid-sludge-free oil, (5) separating the acid sludge from the substantially acid-sludge-free oil, (6) providing said acid sludge to said process for converting acid sludge to asphalt products, and (7) adding a polishing agent to said acid-sludge-free oil, and steam sparging said acid-sludge-free oil to deodorize it, lighten the color thereof and raise the pH to a neutral value; and (8) filtering said acid-sludge-free oil to remove spent polishing agent to create re-refined lubricating oil.

11. The process of claim 9 wherein said high temperature heating step further comprises heating said used oil in an enclosed tank and applying vacuum to said enclosed tank during said heating in a manner so as to draw off vapors outgassing from said used oil, said vapors including said light ends, said vapors being drawn by said vacuum through a heat exchanger condenser so as to cool and condense said vapors and collecting said condensed vapors.

12. The process of claim 9 wherein said high temperature heating step further comprises the step of steam sparging the used oil being heated during the heating process.

13. The process of claim 10 wherein said high temperature heating step further comprises the step of steam sparging the used oil during said high temperature heating step and applying vacuum to the tank in which said used oil is being heated during said high temperature heating step so as to draw off vapors outgassing from said heated used oil into a heat exchanger condenser where the vapors are cooled and condensed for collection.

14. The process of claim 9 wherein said high temperature heating step further comprises heating said used oil in an enclosed tank and applying vacuum to said enclosed tank during said high temperature heating in a manner so as to draw off vapors outgassing from said used oil through a heat exchanger so as to cool and condense said vapors and collecting said condensed vapors.

15. The process of claim 9 wherein said high temperature heating step further comprises the step of steam sparging the used oil being heated during said high temperature heating step and further comprising heating said used oil during said high temperature heating step in an enclosed tank and applying vacuum to said enclosed tank during said heating of said high temperature heating step in a manner so as to draw off vapors outgassing from said used oil through a heat exchanger so as to cool and condense said vapors and collecting said condensed vapors.

16. The process of claim 1 further comprising the steps of creating the acid sludge according to the following process:

(1) providing used oil having impurities including one or more of, water, chlorinated compounds, carbonaceous compounds, metals, oxidizable components and light ends and additives including dispersant additives therein, (2) performing a high temperature heating step comprising heating the oil to a temperature which is high enough and for a time sufficiently long to dissociate at least said dispersant additives thereby allowing more rapid precipitation of acid sludge later when acid is added to the oil after, said high temperature heating step also simultaneously removing said water, light ends and chlorinated compounds having boiling points below the temperature to which said used oil is heated, said high temperature heating step raising the temperature of said used oil to at least 150 degrees Centigrade, (3) cooling the oil, (4) adding a sufficient amount of acid or other oxidizing agent of a concentration and amount adequate to oxidize substantially all said carbonaceous materials, metals and other oxidizable impurities and other undesired components in said used oil and cause the oxidized products to settle out of solution as acid sludge within one to three days, and preferably within 12–24 hours, so as to create a resulting mixture comprising a layer of acid sludge and a layer of substantially acid-sludge free oil, (5) after substantially all acid sludge has settled out of solution, separating the acid sludge from the substantially acid-sludge-free oil, (6) providing said acid sludge to said process for converting acid sludge to asphalt products, and (7) adding a polishing agent to said substantially acid-sludge-free oil, and steam sparging said Substantially acid-sludge-free oil to deodorize it, lighten the color thereof and raise the pH to a neutral value; and (8) filtering said substantially acid-sludge-free oil to remove spent polishing agent to create re-refined lubricating oil.

17. The process of claim 14 wherein said high temperature heating step further comprises the step of bubbling inert gas through the used oil being heated during said high temperature heating step.

18. The process of claim 16 wherein said high temperature heating step further comprises the step of bubbling inert gas through the used oil being heated during the high temperature heating step and wherein said high temperature heating step further comprises the step of steam sparging the used oil being heated during said high temperature heating step.

19. The process of claim 11 further comprising the step of monitoring the temperature of vapors inside said heat exchanger condenser and collecting vapors that condense at temperatures greater than approximately 350° F. in a first collection tank for recycling as fuel oil and collecting vapors that condense at a temperature less than approximately 350° F. in a second collection tank for disposal.

20. The process of claim 13 further comprising the step of monitoring the temperature of vapors inside said condenser and collecting vapors that condense at temperatures greater than approximately 350° F. in a first collection tank for recycling as fuel oil and collecting vapors that condense at a temperature less than approximately 350° F. in a second collection tank for disposal.

21. The process of claim 10 wherein said step of adding acid comprises the step of mixing a stream of dehydrated oil resulting from said high temperature heating step with a stream of acid in a proportionate pump to establish a proportion of 3–15% by volume of acid to dehydrated oil and mixing said acid stream and dehydrated oil in an in-line mixer, and wherein said step of separating said acid sludge from said acid-sludge-free oil is accomplished in a centrifuge.

22. The process of claim 1 further comprising the steps of creating the acid sludge according to the following process:

(1) providing used oil having impurities including one or more of water, chlorinated compounds, carbonaceous compounds, metals, oxidizable components and light ends and additives including dispersant additives therein, (2) generating a quantity Of dehydrated oil by performing a high temperature heating step comprising heating the oil to a temperature greater than 650 degrees Fahrenheit and less than or equal to 1000 degrees Fahrenheit for a time sufficient to dissociate at least said dispersant additives and sufficient to remove water, light ends and chlorinated compounds having boiling points below 650° F., (3) cooling the oil, (4) adding a sufficient amount of acid or other oxidizing agent of a concentration and amount adequate to oxidize substantially all said carbonaceous compounds, metals and other oxidizable impurities and other undesired components in said used oil and cause the oxidized products to settle out of solution as acid sludge within one to three days, and preferably within 12–24 hours, so as to create a resulting mixture comprising a layer of acid sludge and a layer of substantially acid-sludge free oil, (5) separating the acid sludge from the substantially acid-sludge-free oil, (6) providing said acid sludge to said process for converting acid sludge to asphalt products, and (7) adding a polishing agent to said substantially acid-sludge-free oil, and steam sparging said substantially acid-sludge-free oil to deodorize it, lighten the color thereof and raise the pH to a neutral value; and (8) filtering said Substantially acid-sludge-free oil to remove spent polishing agent to create re-refined lubricating oil, and wherein said step of adding acid comprises the step of mixing a stream of dehydrated oil resulting from said high temperature heating step with a stream of acid in a proportionate pump to establish a proportion of 3–15% by volume of acid to dehydrated oil and mixing said acid stream and dehydrated oil in an in-line mixer, and wherein said step of separating said acid sludge from said substantially acid-sludge-free oil is accomplished in a centrifuge.

23. The process of claim 1 further comprising the step adding an additive to said soft asphalt, said additive selected from the group consisting of virgin asphalt, rubber or rubber compounds, resins or polymers to increase the cohesion of the soft asphalt, solvents suitable to produce cut back asphalt and water and emulsifier to produce emulsified asphalt.

24. The process of claim 8 further comprising the step adding an additive to said soft asphalt before conversion thereof to hard asphalt, said additive selected from the group consisting of virgin asphalt, rubber or rubber compounds, resins to increase the cohesion of the soft asphalt, solvents suitable to produce cut back asphalt and water and emulsifier to produce emulsified asphalt.

25. The process of claim 9 wherein said high temperature heating step comprises heating the oil to a temperature in the range from a temperature greater than 700° F. to some temperature preferably less than or equal to 750° F., and wherein the step of adding an oxidizing agent comprises the step of adding sulfuric acid having a concentration of from approximately 80–98 weight %, and adding a volume of sulfuric acid generally comprising 3–15% of the volume of dehydrated oil and, preferably, 5–10% by volume, and wherein the step of adding a polishing agent comprises the step of adding an agent having large pores and large surface area per particle selected from the group consisting of clay, bleaching earth, activated carbon or bauxite to adsorb oxidized particles and particles that color the oil and deodorize, lighten the color and neutralize the acidic nature of the re-refined oil.

26. The process of claim 10 wherein said high temperature heating step comprises heating the oil to a temperature in the range from a temperature greater than 700° F. to some temperature preferably less than or equal to 750° F., and wherein the step of adding an oxidizing agent comprises the step of adding sulfuric acid having a concentration of from approximately 80–98 weight %, and adding a volume of sulfuric acid generally comprising 3–15% of the volume of dehydrated oil and, preferably, 5–10% by volume, and wherein the step of adding a polishing agent comprises the step of adding an agent having large pores and large surface area per particle selected from the group consisting of clay, bleaching earth, activated carbon or bauxite to adsorb oxidized particles and particles that color the oil and deodorize, lighten the color and neutralize the acidic nature of the re-refined oil.

27. The process of claim 9 wherein the step of adding a polishing agent comprises the step of adding a sufficient amount of polishing agent having large pores and large surface area per particle selected from the group consisting of clay, bleaching earth, activated carbon or bauxite so as to absorb oxidized particles and particles that color the oil while steam sparging the oil being treated with the polishing agent so as to deodorize and neutralize the acidic nature of the re-refined oil and lighten the color thereof so as to be from 2.0–5.0, and, preferably, from 2.0–3.0 measured according to the color scale of the American Society for Testing and Materials, method D1500.

28. The process of claim 1 wherein the step of raising the pH comprises the step of adding a liquid having a pH of from about 3 to 14, and further comprising the step of washing said acid sludge after raising the pH thereof so as to remove salts which result therein from the reaction of the pH elevating agent with said acid sludge.

29. The process of claim 1 further comprising the step of heating and agitating the acid sludge while the pH elevating agent is in contact therewith but before separation of said layer of water from said intermediate sludge.

30. The process of claim 9 further comprising the step of agitating the mixture after addition of said oxidizing agent.

31. The process of claim 10 further comprising the step of agitating the mixture after addition of said oxidizing agent.

32. The process of claim 9 further comprising the step of agitating the cooled oil during addition of said polishing agent.

33. The process of claim 10 further comprising the step of agitating the cooled oil during addition of said polishing agent.

34. The process of claim 11 further comprising the steps of separating water and other undesirable components from said light ends in said vapors being condensed in said heat exchanger condenser and using the light ends as fuel for a heater unit used to carry out said high temperature heating step.

35. The process of claim 1 further comprising the steps of creating the acid sludge according to the following process:

(1) providing used oil having impurities including one or more of water, chlorinated compounds, carbonaceous compounds, metals, oxidizable components and light ends and additives including dispersant additives therein, (2) performing a high temperature heating step comprising heating the oil to a temperature greater than 700 degrees Fahrenheit and less than or equal to 1000 degrees Fahrenheit, preferably between 726° F. and 750° F., for a time sufficient to dissociate at least said dispersant additives and to remove said water light ends and chlorinated compounds having boiling points below 700° F., (3) cooling the oil, (4) adding a sufficient amount of acid or other oxidizing agent of a concentration and amount adequate to oxidize substantially all carbonaceous compounds, metals and other oxidizable impurities and other undesired components in said used oil thereby forming oxidized products and causing the oxidized products to settle out of solution as acid sludge within one to three days, and preferably within 12–24 hours, so as to create a resulting mixture comprising a layer of acid sludge and a layer of oil which is substantially free of acid-sludge, (5) separating the acid sludge using a centrifuge so as to generate a volume of substantially acid-sludge-free oil and a volume of acid sludge, (6) providing said acid sludge to said process for converting acid sludge to asphalt products, and (7) adjusting the pH of the substantially acid-sludge-free oil by adding a pH elevating agent to generate heavy fuel oil which is substantially free of heavy metals, chlorinated compounds, sulfur and carbonaceous materials.

36. The process of claim 8 further comprising the steps of creating the acid sludge according to the following process:

(1) providing used oil having impurities including one or more of water, chlorinated compounds, carbonaceous compounds, metals, oxidizable components and light ends and additives including dispersant additives therein, (2) heating the oil to a temperature greater than 700 degrees Fahrenheit and less than or equal to 1000 degrees Fahrenheit, preferably between 726° F. and 750° F., for a time sufficient to dissociate at least said dispersant additives and to remove water, light ends and chlorinated compounds having boiling points below 700° F., (3) cooling the oil, (4) adding a sufficient amount of acid or other oxidizing agent of a concentration and amount adequate to oxidize substantially all carbonaceous compounds, metals and other oxidizable impurities and other undesired components in said used oil thereby forming oxidized products and causing the oxidized products to settle out of solution as acid sludge within one to three days, and preferably within 12–24 hours, so as to create a resulting mixture comprising a layer of acid sludge and a layer of oil which is substantially free of acid-sludge, (5) separating the acid sludge using a centrifuge so as to generate a volume of substantially acid-sludge-free oil and a volume of acid sludge, (6) providing said acid sludge to said process for converting acid sludge to asphalt products, and (7) adjusting the pH of the substantially acid-sludge-free oil by adding a pH elevating agent to generate heavy fuel oil which is substantially free of heavy metals, chlorinated compounds, sulfur and carbonaceous compounds.

37. The process of claim 35 wherein said high temperature heating step further comprises heating said used oil in an enclosed tank and applying vacuum to said enclosed tank during said heating in a manner so as to draw off vapors outgassing from said used oil through a heat exchanger/condenser so as to cool and condense said vapors and collecting said condensed vapors, and further comprising the step of monitoring the temperature of vapors inside said condenser and collecting vapors that condense at temperatures greater than approximately 350° F. in a first collection tank for recycling as fuel oil and collecting vapors that condense at a temperature less than approximately 350° F. in a second collection tank for disposal.

38. The process of claim 36 wherein said high temperature heating step further comprises heating said used oil in an enclosed tank and applying vacuum to said enclosed tank during said heating in a manner so as to draw off vapors outgassing from said used oil through a heat exchanger/condenser so as to cool and condense said vapors and collecting said condensed vapors, and further comprising the step of monitoring the temperature of vapors inside said condenser and collecting vapors that condense at temperatures greater than approximately 350° F. in a first collection tank for recycling as fuel oil and collecting vapors that condense at a temperature less than approximately 350° F. in a second collection tank for disposal.

39. The process of claim 35 wherein said high temperature heating step further comprises heating said used oil in an enclosed tank and applying vacuum to said enclosed tank during said heating in a manner so as to draw off vapors outgassing from said used oil, said vapors including said light ends, said vacuum drawing said vapors through a heat exchanger/condenser so as to cool and condense said vapors and collecting said condensed vapors as a liquid including water and light ends, and further comprising the step of separating the water from the light ends in said liquid generated by condensing said vapors and heating said light ends to a temperature of 100° C. to 150° C. to remove any chlorinated compounds therein so as to leave chlorine-free, light fuel oil, and further comprising the step of oxidizing any sulfur compounds in said chlorine-free, light fuel oil by addition of an oxidizing agent thereto to cause any sulfur compounds to precipitate as acid sludge to leave chlorine-free, substantially sulfur-free, light fuel oil, and further comprising the step of conveying said acid sludge to the input point of said process of converting acid sludge to asphalt, and further comprising the step of adjusting the pH of said chlorine-free, substantially sulfur-free, light fuel oil to a neutral value by addition of a pH elevating agent selected from the group consisting of amine compound and caustic solution and removing any resulting solids or water from the resulting neutral pH, sulfur-free, chlorinated-compound-free light fuel oil.

* * * * *